US008138852B2

(12) United States Patent
Kawai et al.

(10) Patent No.: US 8,138,852 B2
(45) Date of Patent: Mar. 20, 2012

(54) DUPLEXER AND TRANSCEIVER

(75) Inventors: Kunihiro Kawai, Yokohama (JP); Hiroshi Okazaki, Zushi (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 600 days.

(21) Appl. No.: 12/259,763

(22) Filed: Oct. 28, 2008

(65) Prior Publication Data

US 2009/0121803 A1 May 14, 2009

(30) Foreign Application Priority Data

Oct. 31, 2007 (JP) ..... 2007-282757
Apr. 10, 2008 (JP) ..... 2008-102365

(51) Int. Cl.
*H01P 5/12* (2006.01)

(52) U.S. Cl. ..... 333/101; 333/132

(58) Field of Classification Search ..... 333/101, 333/124–126, 132, 134, 202, 205
See application file for complete search history.

(56) References Cited

U.S. PATENT DOCUMENTS

| | | | | |
|---|---|---|---|---|
| 5,023,866 | A | 6/1991 | De Muro | |
| 5,162,759 | A | 11/1992 | Yajima | |
| 5,659,274 | A * | 8/1997 | Takahashi et al. | 333/204 |
| 6,147,571 | A | 11/2000 | Kitazawa et al. | |
| 6,307,448 | B1 * | 10/2001 | Atokawa et al. | 333/202 |
| 6,987,950 | B2 * | 1/2006 | Coan | 455/78 |
| 2003/0025563 | A1 | 2/2003 | Christensen | |
| 2003/0222729 | A1 * | 12/2003 | Wong | 333/17.1 |
| 2004/0251987 | A1 | 12/2004 | Nakamura et al. | |
| 2005/0190018 | A1 | 9/2005 | Kawai et al. | |
| 2006/0087388 | A1 | 4/2006 | Kawai et al. | |
| 2008/0061909 | A1 | 3/2008 | Kawai et al. | |

FOREIGN PATENT DOCUMENTS

| | | |
|---|---|---|
| CN | 1656679 A | 8/2005 |
| JP | 2001-230602 | 8/2001 |
| JP | 2004-7352 | 1/2004 |

(Continued)

OTHER PUBLICATIONS

George L. Matthaei, et al., "Some General Applications of Filter Structures in Microwave Engineering", ("Microwave filters, impedance matching networks, and coupling structures"), Artech House Books, XP-002513077, pp. 1-3 and pp. 965-966.

(Continued)

*Primary Examiner* — Robert Pascal
*Assistant Examiner* — Hardadi Sumadiwirya
(74) *Attorney, Agent, or Firm* — Oblon, Spivak, McClelland, Maier & Neustadt, L.L.P.

(57) ABSTRACT

A duplexer according to the present invention includes a first port, a second port and a third port for external input/output, a first path formed between the first port and the third port, a second path formed between the second port and the third port, a phase shifting part provided for each path, and a resonating part provided for each path. At least any of the resonating parts has a ring conductor having a length equal to one wavelength at a resonant frequency or an integral multiple thereof, a plurality of passive circuits, and a plurality of switches each of which is connected to a different part of the ring conductor at one end and to any of the passive circuits at the other end. A switch may simply be connected to a ground conductor instead of being connected to the passive circuit.

5 Claims, 29 Drawing Sheets

FOREIGN PATENT DOCUMENTS

JP 2005-217852 8/2005

OTHER PUBLICATIONS

Dimitrios Peroulis, et al., "Tunable Lumped Components with Applications to Reconfigurable MEMS Filters", IEEE MTT-S Digest, TU4C-6, 2001, pp. 341-344.
Hong-Teuk Kim, et al., "Low-Loss and Compact V-Band MEMS-Based Analog Tunable Bandpass Filters", IEEE Microwave and Wireless Components Letters, vol. 12, No. 11, Nov. 2002, pp. 432-434.
E. Fourn, et al., "Bandwidth and Central Frequency Control on Tunable Bandpass Filter by Using MEMS Cantilevers", IEEE MTT-S Digest, IFTU-21, 2003, pp. 523-526.
Arnaud Pothier, et al., "Low-Loss 2-Bit Tunable Bandpass Filters Using MEMS DC Contact Switches", IEEE Transactions on Microwave Theory and Techniques, vol. 53, No. 1, Jan. 2005, pp. 354-360.
Bruce E. Carey-Smith, et al., "Wide Tuning-Range Planar Filters Using Lumped-Distributed Coupled Resonators", IEEE Transactions on Microwave Theory and Techniques, vol. 53, No. 2, Feb. 2005, pp. 777-785.
Kamran Entesari, et al., "A Differential 4-bit 6.5-10-GHz RF MEMS Tunable Filter", IEEE Transactions on Microwave Theory and Techniques, vol. 53, No. 3, Mar. 2005, pp. 1103-1110.
Kamran Entesari, et al., "A 12-18-GHz Three-Pole RF MEMS Tunable Filter", IEEE Transactions on Microwave Theory and Techniques, vol. 53, No. 8, Aug. 2005, pp. 2566-2571.
Lung-Hwa Hsieh, et al., "Slow-Wave Bandpass Filters Using Ring or Stepped-Impedance Hairpin Resonators", IEEE Transactions on Microwave Theory and Techniques, vol. 50, No. 7, Jul. 2002, pp. 1795-1800.
Kunihiro Kawai, et al., "Tunable Resonator Employing Comb-Shaped Transmission Line and Switches", Oct. 2005, 4 Pages.
Arun Chandra Kundu, et al., "Attenuation Pole Frequency Control of a Dual-Mode Circular Microstrip Ring Resonator BPF", 29$^{th}$ European Microwave Conference, 1999, pp. 329-332.
Kunihiro Kawai, et al., "Tunable Band-pass Filter Employing Comb-shaped Transmission Line Resonator", C-2-37, 2005, p. 58 (with English Translation).
Kunihiro Kawai, et al., "Center-frequency and Bandwidth Tunable Band-pass Filter Employing Comb-shaped Transmission Line Resonator", C-2-35, 2006, p. 66 (with English Translation).
Kunihiro Kawai, et al., "Center Frequency and Bandwidth Tunable Filter Employing Tunable Comb-Shaped Transmission Line Resonators and J-inverters", Proceedings of the 36$^{th}$ European Microwave Conference, Sep. 2006, pp. 649-652.
Kunihiro Kawai, et al., "Comb-shaped Transmission Line Tunable Resonator Employing MEMS RF Switches", 2006, p. 96 (with English Translation).
Lei Zhu, et al., "A Joint Field/Circuit Design Model of Microstrip Ring Dual-Mode Filter: Theory and Experiments", Asia Pacific Microwave Conference, 4P18-7, 1997, pp. 865-868.
S.H. Al-Charchafchi, et al., "Varactor tuned Microstrip ring resonators", IEE Proceedings, vol. 136, Pt. H, No. 2, Apr. 1989, pp. 165-168.
T. Scott Martin, et al., "Electronically Tunable and Switchable Filters Using Microstrip Ring Resonator Circuits", IEEE MTT-S Digest, OF-2-22, 1988, pp. 803-806.
P. Gardner, et al., "Microwave voltage tuned Microstrip ring resonator oscillator", Electronic Letters, vol. 30, No. 21, Oct. 13, 1994, pp. 1770-1771.
Michiaki Matsuo, et al., "Dual-Mode Stepped-Impedance Ring Resonator for Bandpass Filter Applications", IEEE Transactions on Microwave Theory and Techniques, vol. 49, No. 7, Jul. 2001, pp. 1235-1240.
Hitoshi Ishida, et al., "A design of tunable UWB filters", IEEE, FA4-5, May 2004, pp. 424-428.
Kouki Saitou, et al., "Tunable Duplexer Having Multilayer Structure Using LTCC", IEEE MTT-S Digest, TH1C-5, 2003, pp. 1763-1766.
F.A. Miranda, et al., "A K-Band (HTS,Gold)/Ferroelectric Thin Film/Dielectric Diplexer for a Discriminator-Locked Tunable Oscillator", IEEE Transactions on Applied Superconductivity, vol. 9, No. 2, Jun. 1999, pp. 3581-3584.
Masaaki Koiwa, et al., "Multiband Mobile Terminals", NTT DoCoMo Technical Journal, vol. 8, No. 2, Jul. 2006, pp. 31-37 (with English Translation).
Kunihiro Kawai, et al., "Ring Resonators for Bandwidth and Center Frequency Tunable Filter", Proceedings of the 37$^{th}$ European Microwave Conference, Oct. 2007, pp. 298-301.
Office Action issued Jul. 26, 2011, in Chinese Patent Application No. 200810172808.2 with English translation.

* cited by examiner

| RESONANT FREQUENCY (GHz) | $C_1$ (pF) | CUTOFF FREQUENCY (GHz) | ϕ (deg) | θ1 (deg) | θ2 (deg) |
|---|---|---|---|---|---|
| 5 | 0 | 6.43 | 45 | 30 | 140 |
| | | | | 150 | 140 |
| | | | | 140 | 30 |
| | | | | 140 | 150 |
| | | | 46 | 150 | 40 |
| | | | 59 | 30 | 40 |
| | | | 70 | 40 | 30 |
| | | | | 40 | 150 |
| | | 6 | 58 | 150 | 40 |
| | | | | 150 | 140 |
| | | | 60 | 140 | 30 |
| | | | | 140 | 150 |
| | | | 75 | 30 | 40 |
| | | | | 30 | 140 |
| | | | 85 | 40 | 30 |
| | | | | 40 | 150 |
| | | 5.62 | 70 | 160 | 10 |
| | | | | 160 | 170 |
| | | | 72 | 10 | 20 |
| | | | | 10 | 160 |
| | | | | 170 | 20 |
| | | | | 170 | 160 |
| | | | 80 | 20 | 10 |
| | | | | 20 | 170 |
| | | 5.29 | 80 | 170 | 20 |
| | | | | 170 | 160 |
| | | | 85 | 10 | 20 |
| | | | | 10 | 160 |
| | | | | 160 | 10 |
| | | | | 160 | 170 |
| | | | 99 | 20 | 10 |
| | | | | 20 | 170 |

COMBINATION THAT PROVIDE GREAT VARIATION OF ϕ

COMBINATION THAT PROVIDE SMALL VARIATION OF ϕ

FIG.36

| RESONANT FREQUENCY (GHz) | $C_1$ (pF) | CUTOFF FREQUENCY (GHz) | ϕ (deg) | θ1 (deg) | θ2 (deg) |
|---|---|---|---|---|---|
| 3.43 | 1 | 4.33 | 82 | 140 | 30 |
| | | | | 140 | 150 |
| | | | 83 | 150 | 40 |
| | | | | 150 | 140 |
| | | | 98 | 30 | 40 |
| | | | | 30 | 140 |
| | | | 104 | 40 | 30 |
| | | | | 40 | 150 |
| | | 4.13 | 93 | 150 | 40 |
| | | | | 150 | 140 |
| | | | 94 | 140 | 150 |
| | | | | 140 | 30 |
| | | | 109 | 30 | 40 |
| | | | | 30 | 140 |
| | | | 115 | 40 | 30 |
| | | | | 40 | 150 |
| | | 3.89 | 105 | 160 | 10 |
| | | | | 160 | 170 |
| | | | 108 | 10 | 20 |
| | | | | 10 | 160 |
| | | | | 170 | 20 |
| | | | | 170 | 160 |
| | | | 115 | 20 | 10 |
| | | | | 20 | 170 |
| | | | 118 | 170 | 20 |
| | | | | 170 | 160 |
| | | 3.65 | 122 | 160 | 10 |
| | | | | 160 | 170 |
| | | | 123 | 10 | 20 |
| | | | | 10 | 160 |
| | | | 136 | 20 | 10 |
| | | | | 20 | 170 |

COMBINATION THAT PROVIDE GREAT VARIATION OF ϕ

COMBINATION THAT PROVIDE SMALL VARIATION OF ϕ

FIG.37

DUPLEXER AND TRANSCEIVER

BACKGROUND OF THE INVENTION

The present invention relates to a duplexer and a transceiver used in a bidirectional communication apparatus using a radio wave.

In the field of radio communication using radio waves, there is the so-called frequency division duplex communication in which different frequencies are used for transmission and reception. A station that uses one antenna to accomplish bidirectional communication has a duplexer to prevent the signal transmitted by the station from directly entering the circuit for receiving signals from other stations. In general, the frequency characteristics of the duplexer cannot be changed. Therefore, a communication apparatus capable of using a plurality of frequency bands has a plurality of duplexers and switches among the duplexers in order to cover the plurality of frequency bands (see Masaaki Koiwa, Fumiyoshi Inoue and Takashi Okada, "Multiband Mobile Terminals", NTT DoCoMo Technical Journal, Vol. 14, No. 2, pp. 31-37, July 2006).

Conventional approaches have a problem that the circuit area and the number of components increase as the number of frequency bands increases. In general, the duplexer has a filter that permits a signal at the transmission frequency to pass therethrough and reflects a signal at the other frequencies and a filter that permits a signal at the reception frequency to pass therethrough and reflects a signal at the other frequencies. Alternatively, a duplexer capable of changing the frequency characteristics can be used, and the frequency characteristics can be appropriately changed. However, in the typical frequency division duplex communication, the transmission frequency and the reception frequency are relatively close to each other, and therefore, the filters have to have a narrow frequency band. In order for the filters to have a narrow band (or in order to bring the transmission zero close to the resonant frequency), the filters have to have a plurality of resonators. Thus, there remains the problem that the circuit area and the number of component increase.

The present invention has been made in view of such circumstances, and an object of the present invention is to provide a duplexer that functions as a filter having variable frequency characteristics and is reduced in circuit area and number of components and a small and lightweight transceiver.

SUMMARY OF THE INVENTION

A duplexer according to the present invention comprises a first port, a second port and a third port for external input/output, a first path being formed between the first port and the third port, and a second path being formed between the second port and the third port, a phase shifting part provided for each path, and a resonating part provided for each path. At least any of the resonating parts has a ring conductor having a length equal to one wavelength at a resonant frequency or an integral multiple thereof, a plurality of passive circuits, and a plurality of switches each of which is connected to a different part of the ring conductor at one end and to any of the passive circuits at the other end. The term "ring conductor" means a conductor (a transmission line) having the opposite ends thereof connected to each other, which is not limited to a particular shape. That is, the shape of the ring conductor is not limited to a circular shape, but the ring conductor can have any other shape, such as a polygonal shape. A switch may simply be connected to a ground conductor instead of being connected to the passive circuit. A switch may select from among a plurality of passive circuits and a terminal connected to a ground conductor. The resonating part may have three or more variable reactance means connected to the ring conductor. The number of ports of the duplexer can be increased, and the number of paths can be increased. Thus, the duplexer according to the present invention has at least three ports and at least two paths.

Effect of the Invention

The duplexer according to the present invention can change the bandwidth and in-band and out-band characteristics of the resonating parts by selecting from among switches. That is, the frequency characteristics of the filter can be changed. Furthermore, if a passive circuit is used, the frequency characteristics can be more easily biased, so that the number of resonating parts can be reduced, and the duplexer can be downsized. Furthermore, if three or more variable reactance means are connected to a resonating part, the resonant frequency can be changed, and therefore, the duplexer can change the frequency band. If such a duplexer is used in a transceiver, the transceiver can be reduced in size and weight.

Figure 35:
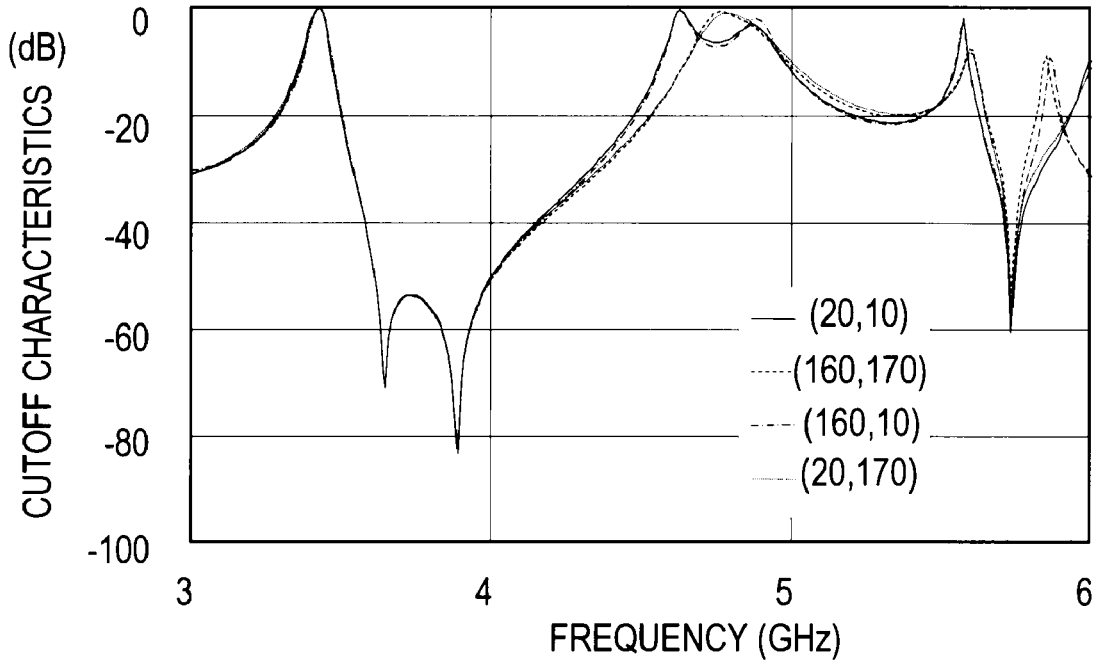
Figure 38C:
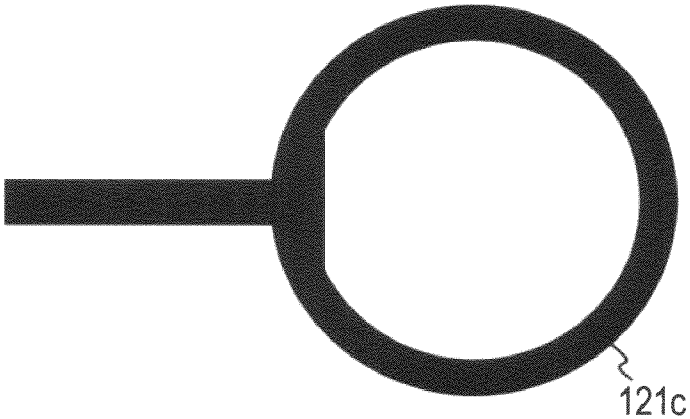
Figure 38A:
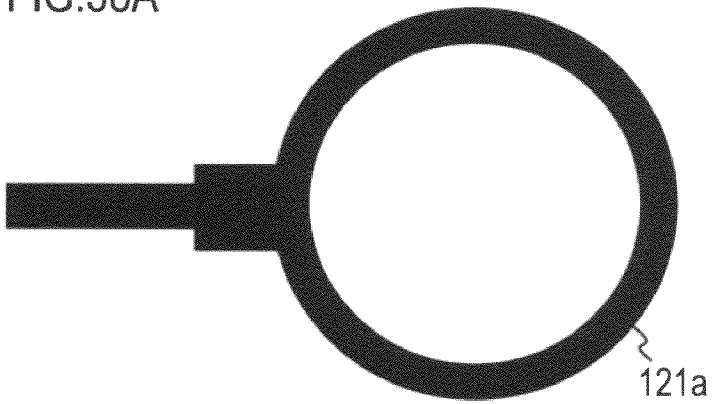
Figure 38B:
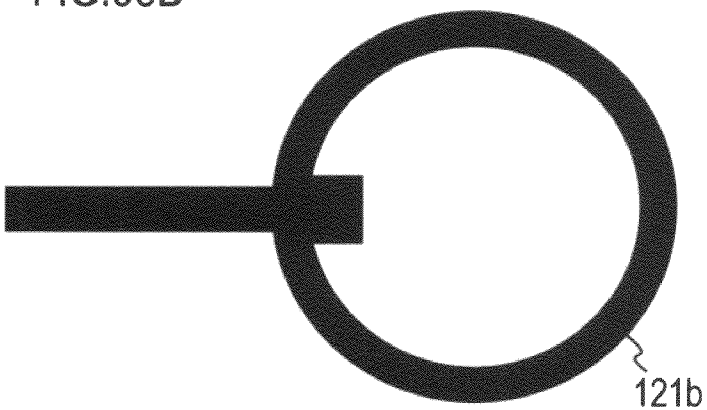

GHz, the cutoff frequencies are 3.89 GHz and 3.65 GHz, and the positions of switches ($\theta_1$, $\theta_2$) are (20°, 10°), (160°, 170°), (160°, 10°) and (20°, 170°);

FIG. 35 is a graph showing frequency characteristics for the cases where the resonant frequency is 3.43 GHz, the cutoff frequencies are 3.89 GHz and 3.65 GHz, and the positions of switches ($\theta_1$, $\theta_2$) are (20°, 10°), (160°, 170°), (160°, 10°) and (20°, 170°);

FIG. 36 is a table showing results of a simulation in the case where the resonant frequency is 5 GHz;

FIG. 37 is a table showing results of a simulation in the case where the resonant frequency is 3.43 GHz;

FIG. 38A shows a configuration of the ring conductor and an input/output line in which the input/output line is slightly thicker in a part close to the point of connection between the ring conductor and the input/output line;

FIG. 38B shows a configuration of the ring conductor and the input/output line in which there is a stub in the vicinity of the point of connection between the ring conductor and the input/output line; and FIG. 38C shows a configuration of the ring conductor and the input/output line in which the ring conductor is widened in a part close to the point of connection between the ring conductor and the input/output line.

DETAILED DESCRIPTION OF THE PREFERRED EMBODIMENTS

Embodiment 1

Figure 1:
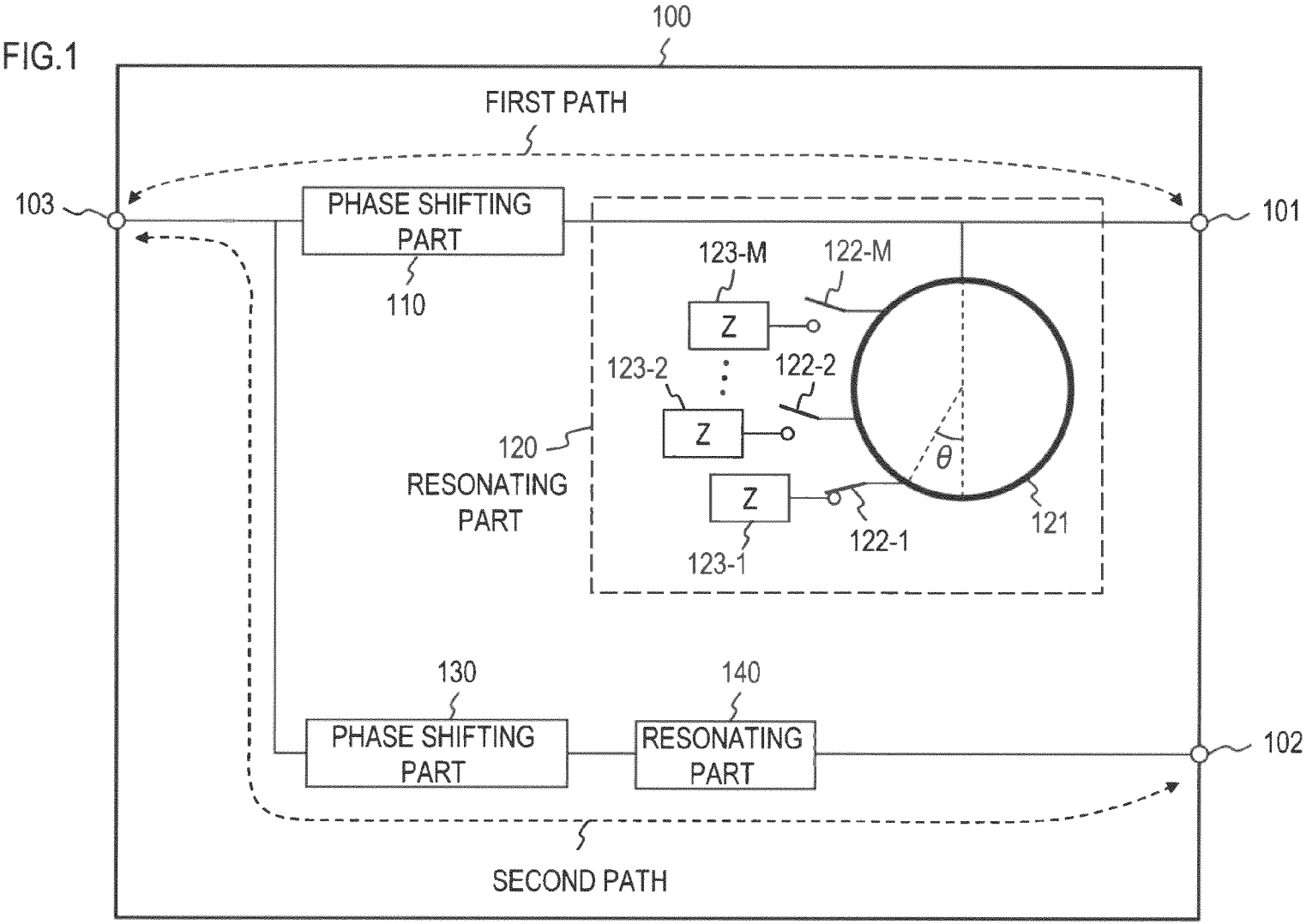
FIG. 1 is a diagram showing an exemplary configuration of a duplexer according to an embodiment 1.

FIG. 1 shows an exemplary configuration of a duplexer according to an embodiment 1. A duplexer 100 has a first port 101, a second port 102 and a third port 103 for external input/output. A first path is formed between the first port 101 and the third port 103, and a second path is formed between the second port 102 and the third port 103. The first path includes a phase shifting part 110 and a resonating part 120, and the second path includes a phase shifting part 130 and a resonating part 140. At least the resonating part 120 has a ring conductor 121 having a length equal to one wavelength at a resonant frequency or an integral multiple thereof, a plurality of passive circuits 123-1 to 123-M, and a plurality of switches 122-1 to 122-M each of which is connected to a different part of the ring conductor 121 at one end and to any of the passive circuits 123-1 to 123-M at the other end (M represents an integer equal to or greater than 2). Although the switches 122-1 to 122-M are disposed only on the left side of the ring conductor in FIG. 1, the switches may be disposed only on the right side of the ring conductor or distributed on both the left and right sides of the ring conductor. The same holds true for the other drawings. The term "ring conductor" means a conductor (a transmission line) having the opposite ends thereof connected to each other, which is not limited to a particular shape. The shape of the ring conductor is not limited to a circular shape, but the ring conductor can have any other shape, such as a polygonal shape. The "passive circuit" means a circuit composed of one or more passive elements or transmission lines. The passive circuit may be connected to a ground conductor or be open at a part thereof. One of the paths functions as a filter that permits a transmission frequency to pass therethrough and reflects the other frequencies, and the other path functions as a filter that permits a reception frequency to pass therethrough and reflects the other frequencies.

Figure 2B:
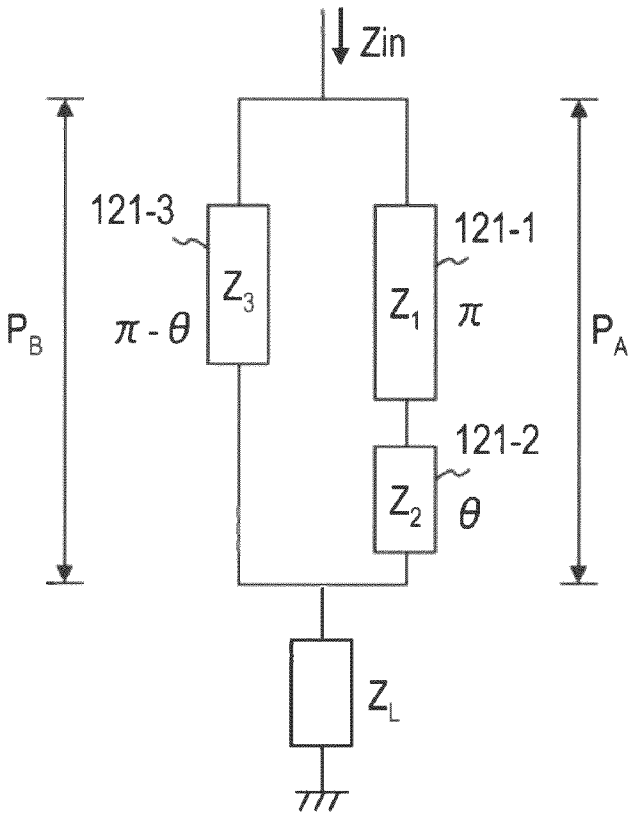
FIG. 2B is a diagram showing an equivalent circuit of a lossless transmission line model.
Figure 2A:
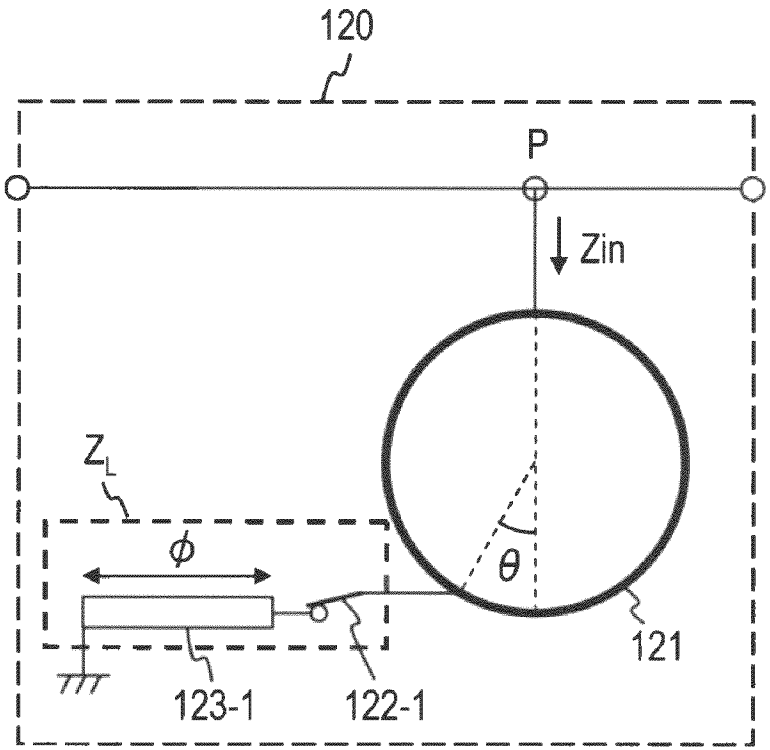
FIG. 2A is a diagram showing a configuration of a resonating part.

FIG. 2A shows a configuration of the resonating part 120. FIG. 2B shows an equivalent circuit of a lossless transmission line model of the resonating part. $Z_{in}$ denotes the input impedance of the resonating part viewed from a point P in the direction of the ring conductor 121. An operation of the resonating part 120 will be described by determining the input impedance $Z_{in}$ of the model. It is supposed that, at a resonant frequency $f_r$, a transmission line 121-1 has an electrical length of $\pi$ (which is equal to a half of the wavelength at the resonant frequency $f_r$) and a characteristic impedance of $Z_1$, a transmission line 121-2 has an electrical length of $\theta$ (which is equal to $\theta/2\pi$ of the wavelength of the resonant frequency $f_r$) and a characteristic impedance of $Z_2$, and a transmission line 121-3 has an electrical length of ($\pi-\theta$) and a characteristic impedance of $Z_3$. As is apparent from this model, the total sum of the electrical lengths of the transmission lines 121-1, 121-2 and 121-3 is $2\pi$, that is, 360°. The passive circuit 123-1 has an electrical length of $\phi$ and a characteristic impedance of $Z_L$.

A path $P_A$ composed of the transmission line 121-1 and the transmission line 121-2 is a path extending clockwise to the switch 122-1 in the on state shown in FIG. 2A, and a path $P_B$ composed of the transmission line 121-3 is a path extending counterclockwise to the switch 122-1 in the on state shown in FIG. 2A.

The input impedance $Z_{in}$ in this case is expressed by the following formula (1). In the following, j represents the imaginary unit.

$$Z_{in} = \frac{y_{22} + Y_L}{y_{11}(y_{22} + Y_L) - y_{12}y_{21}} \tag{1}$$

In this formula, $$y_{11} = -jY_2 \cot\theta + jY_3 \cot\theta$$

$$y_{12} = -jY_2 csc\theta + jY_3 csc\theta$$

$$y_{21} = -jY_2 csc\theta + jY_3 csc\theta$$

$$y_{22} = -jY_2 \cot\theta + jY_3 \cot\theta$$

$$Y_2 = 1/Z_2, Y_3 = 1/Z_3, Y_L = 1/Z_L,$$

where, L denotes the length of the ring conductor, and $\theta = x/2\pi L$ (rad). As can be seen from the formula (1), when $Y_2 = Y_3$, the impedance $Z_{in}$ is infinity except when $\theta$ is 0 or an integral multiple of $\pi$. When $\theta$ is 0 or an integral multiple of $\pi$, $Z_{in} = Z_L$. That is, when the line length (physical length) x changes, the resonant frequency is constant except in the case where the line length reduced to the electrical length at the resonant frequency is 0 or an integral multiple of T.

Figure 3:
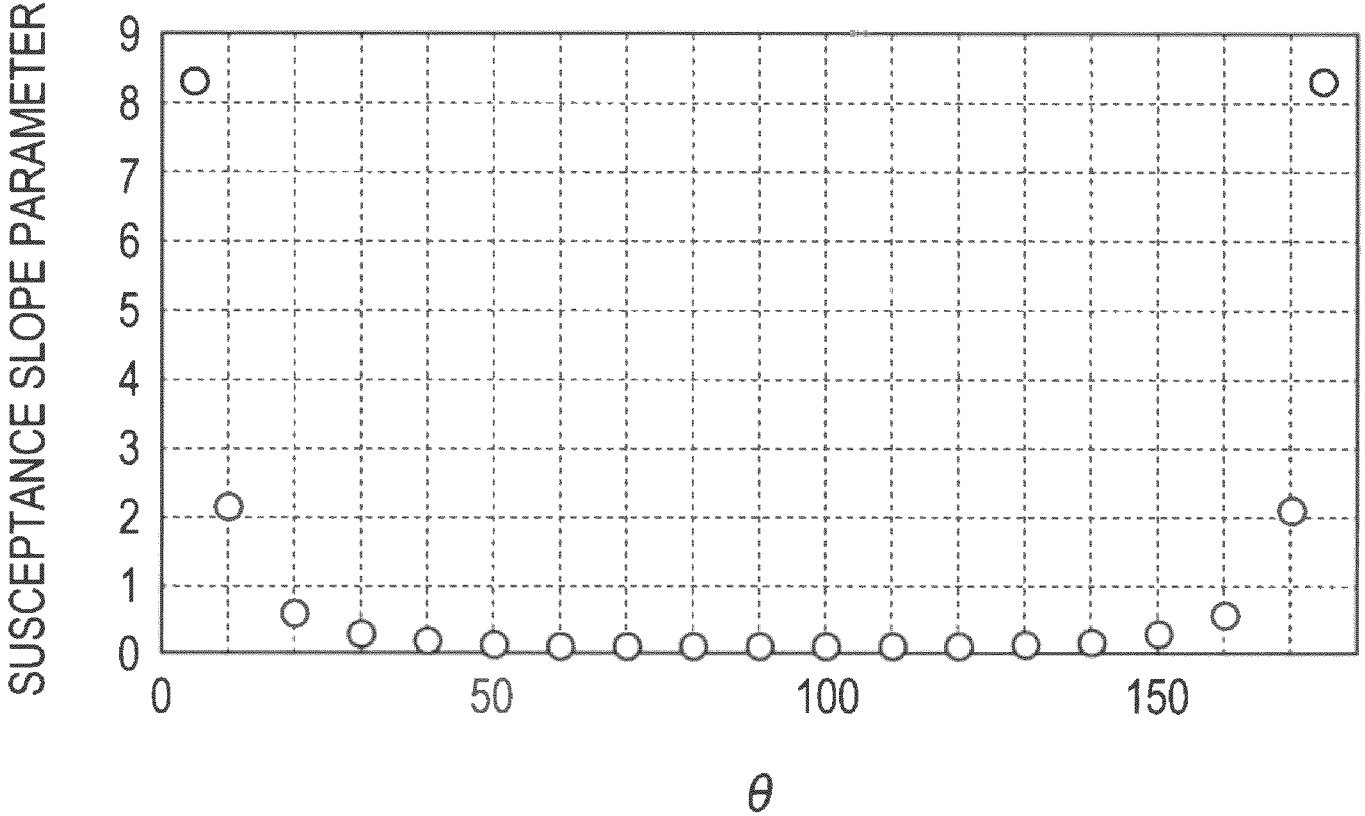
FIG. 3 is a graph showing a variation of the susceptance slope parameter with respect to $\theta$ in a single resonator.

Next, FIG. 3 shows a variation of the susceptance slope parameter with respect to $\theta$ in a single resonator in a case where the impedances $Z_1$, $Z_2$ and $Z_3$ are 50Ω, and the electrical length $\phi$ is 0. The susceptance slope parameter b is determined from the following formula.

$$b = \frac{\omega_0}{2} \frac{dB}{d\omega}\Big|_{\omega_0} \tag{2}$$

, where $B = Im(Y_{in})$, and $Y_{in} = 1/Z_{in}$.

From FIG. 3, it can be seen that the susceptance slope parameter can be changed without changing the resonant frequency by changing the value $\theta$ or, in other words, changing the switch to be turned on. In addition, as can be seen from the formula (2), the susceptance slope parameter indicates the degree of variation of the imaginary part of the admittance with respect to the frequency. As the susceptance slope parameter increases, the admittance changes more greatly with respect to the difference frequency with respect to the resonant frequency, so that, in a band-pass filter using parallel resonance, for example, the bandwidth becomes narrower. In addition, the susceptance slope parameter determines the in-band and out-band characteristics. That is, the bandwidth and the in-band and out-band characteristics can be changed by adjusting the resonating part in the signal selecting device, and the bandwidth can be changed while keeping the center frequency constant by changing the susceptance slope parameter. The resonating part having a ring conductor having an electrical length ϕ of 0 is described in detail in the non-patent literature 2 (Kunihiro Kawai, Hiroshi Okazaki, Shoichi Narahashi, "Ring Resonators for Bandwidth and Center Frequency Tunable Filter", Proceedings of the 37th European Microwave Conference, pp. 298-301, October 2007) and the US Patent Application Publication No. 2008-0061909 of the present applicant. Specifically, the ring conductor of the resonating part can be configured as described in these literatures.

Next, the phase shifting parts 110 and 130 will be described. It is supposed that, in the duplexer 100, the center frequency of the pass band of the resonating part 120 is denoted by f1, and the center frequency of the pass band of the resonating part 140 is denoted by f2. The first path is intended to permit a signal at the frequency f1 to pass therethrough and cut off a signal at the frequency f2. The signal at the frequency f2 to be cut off by the first path is the signal intended to pass through the second path and therefore is desirably prevented from entering the first path. In this regard, the most efficient way of guiding the signal at the frequency f2 into the second path is to increase the input impedance at the frequency f2 viewed from the third port 103 in the direction of the first port 101 to infinity. This is because even if the resonating part 120 reflects the signal at the frequency f2, the input impedance of the resonating part 120 at the frequency f2 is not always infinite (open-circuit). Therefore, the phase shifting part 110 is used to adjust the impedance of the first path at the frequency f2 to be infinite. The phase shifting part 130 in the second path also serves to increase the input impedance at the frequency f1 viewed from the third port 103 in the direction of the second port 102 to infinity. However, in the actual manufacture of the duplexer, the input impedance of the first path and the second path is not always ideally infinite. Thus, in actual, the expression "increase the input impedance to infinity" herein means increasing the input impedance as far as possible to minimize the insertion loss in the pass band of each path.

Figure 4A:
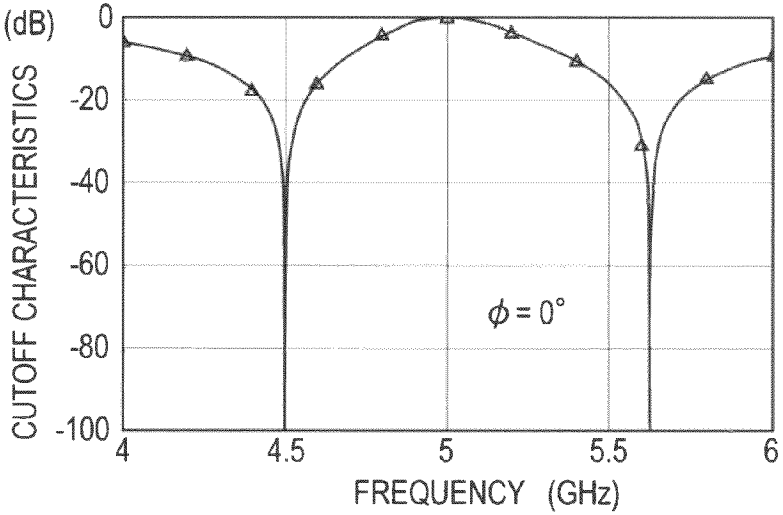
FIG. 4A is a graph showing frequency characteristics of a resonating part in which a passive circuit is a line having a short-circuited end having an electrical length $\phi$ of 0°.
Figure 4B:
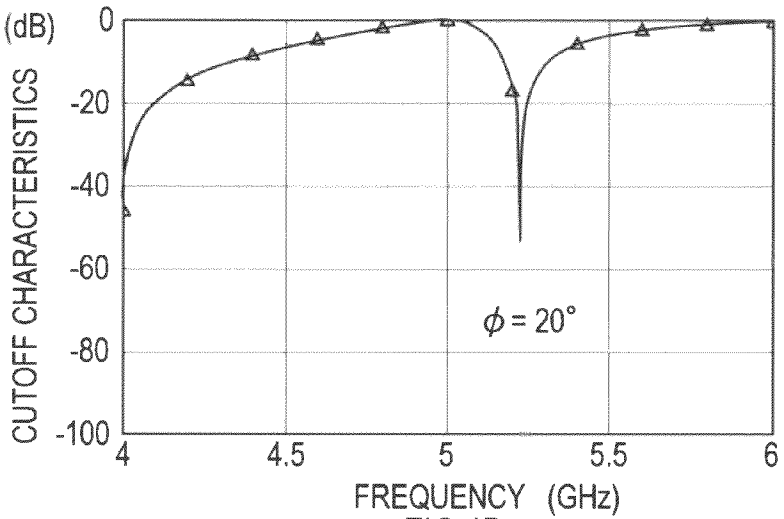
FIG. 4B is a graph showing frequency characteristics of the resonating part in which the passive circuit is a line having a short-circuited end having an electrical length $\phi$ of 20°.
Figure 4C:
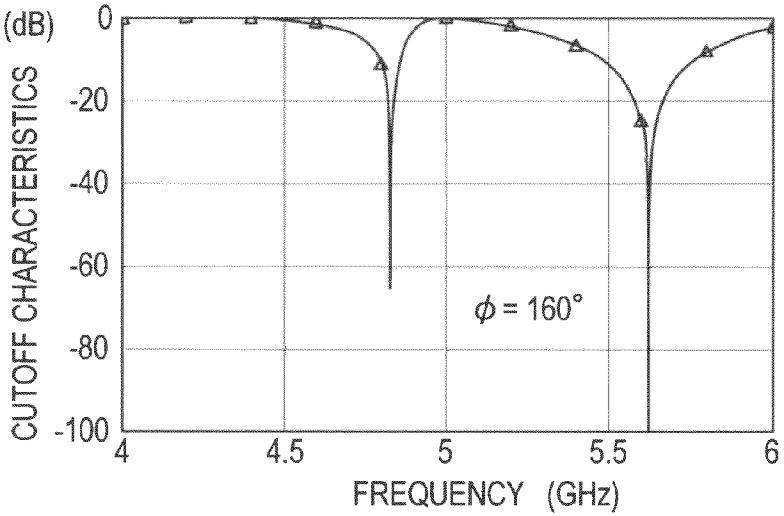
FIG. 4C is a graph showing frequency characteristics of the resonating part in which the passive circuit is a line having a short-circuited end having an electrical length $\phi$ of 160°.
Figure 4D:
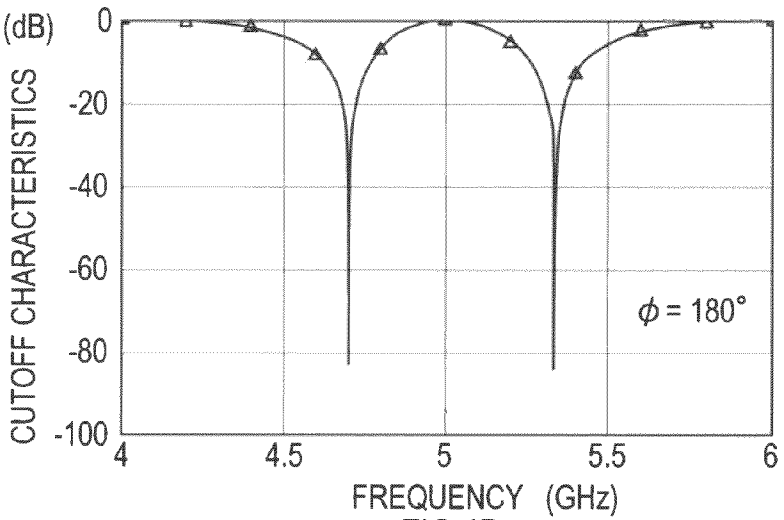
FIG. 4D is a graph showing frequency characteristics of the resonating part in which the passive circuit is a line having a short-circuited end having an electrical length $\phi$ of 180°.

FIG. 4A is a graph showing frequency characteristics of the resonating part in which the passive circuit is a line having a short-circuited end having an electrical length ϕ of 0°. FIG. 4B is a graph showing frequency characteristics of the resonating part in which the passive circuit is a line having a short-circuited end having an electrical length ϕ of 20°. FIG. 4C is a graph showing frequency characteristics of the resonating part in which the passive circuit is a line having a short-circuited end having an electrical length ϕ of 160°. FIG. 4D is a graph showing frequency characteristics of the resonating part in which the passive circuit is a line having a short-circuited end having an electrical length ϕ of 180°. The state where the electrical length ϕ is 0° is equivalent to a state where there is no line having a short-circuited end (a state where one end of the switch 122-1 is connected to a ground conductor). As can be seen from FIG. 4A, in this case, the frequency characteristics of the resonating part are substantially symmetrical with respect to the resonant frequency in the vicinity of the resonant frequency. The frequency characteristics shown in FIG. 4D are close to the frequency characteristics shown in FIG. 4A and are symmetrical with respect to the resonant frequency in the vicinity of the resonant frequency. This is because the line having a short-circuited end having an electrical length ϕ of 180° is virtually short-circuited at the point where the line is connected to the resonating part, and this is substantially the same condition as in the case where the electrical length ϕ is 0°. As shown in FIG. 4B, in the case where the electrical length ϕ is 20°, the frequency characteristics of the resonating part are biased toward lower frequencies with respect to the resonant frequency. The resonating part has abrupt cutoff characteristics at higher frequencies in the vicinity of the resonant frequency. To the contrary to the case shown in FIG. 4B, as shown in FIG. 4C, in the case where the electrical length ϕ is 160°, the frequency characteristics of the resonating part are biased toward higher frequencies with respect to the resonant frequency. And, the resonating part has abrupt cutoff characteristics at lower frequencies in the vicinity of the resonant frequency. As described above, the passive circuit 123-1 connected to the switch can bias the frequency characteristics of the resonating part 120 along the frequency axis.

The duplexer 100 can change the bandwidth and the in-band and out-band characteristics of the resonating part by selecting from among the switches. In other words, if the duplexer 100 is used, the frequency characteristics of each path functioning as a filter can be changed. If the passive circuit is used, the frequency characteristics can be more easily biased. Furthermore, it is easy to design the passive circuit to have an electrical length that makes the frequency permitted to pass through the first path be the resonant frequency and makes the frequency permitted to pass through the second path be the transmission zero (the cutoff frequency). Therefore, the required frequency characteristics can be easily achieved with a reduced number of resonating parts, so that the circuit area of the duplexer and the number of components thereof can be reduced.

Embodiment 2

Figure 5A:
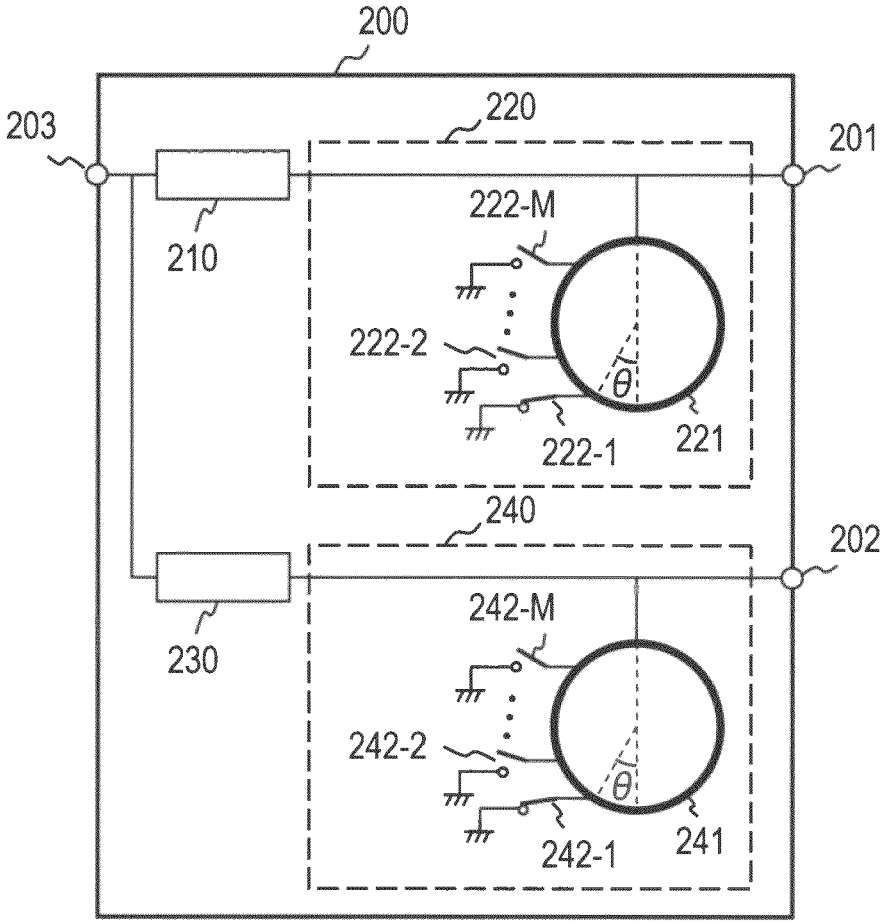
FIG. 5A is a diagram showing an exemplary functional configuration of a duplexer in which one resonating part having switches each connected to a ground conductor at one end is provided for each path.
Figure 5B:
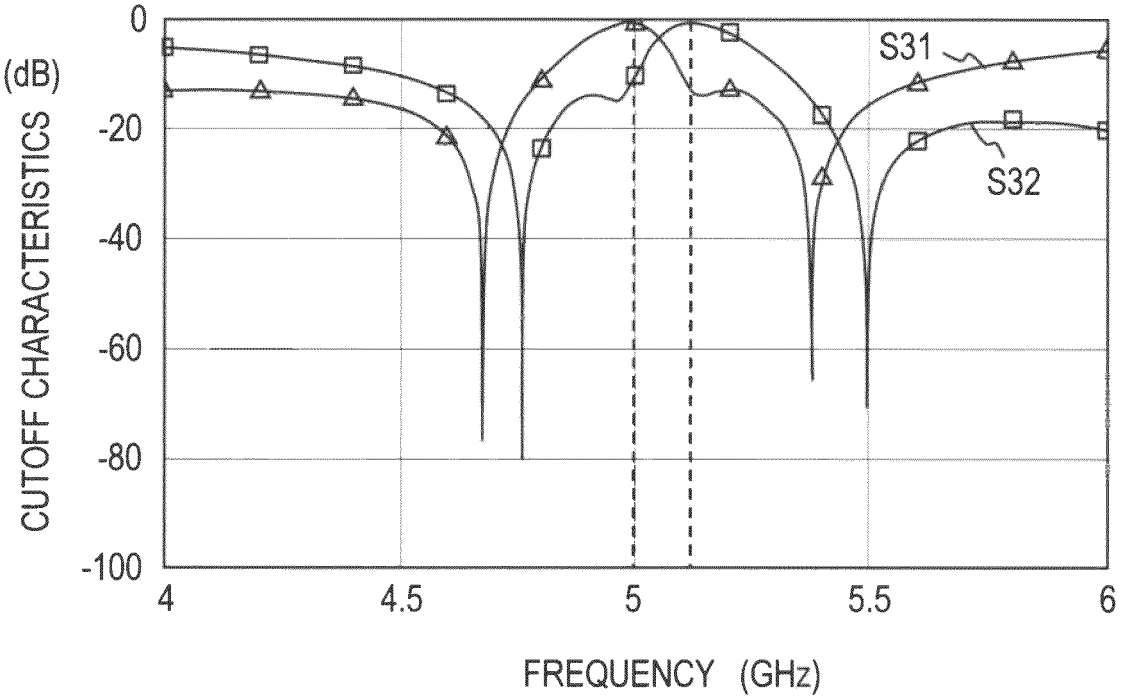
FIG. 5B is a graph showing frequency characteristics of the duplexer having the functional configuration shown in FIG. 5A.
Figure 6A:
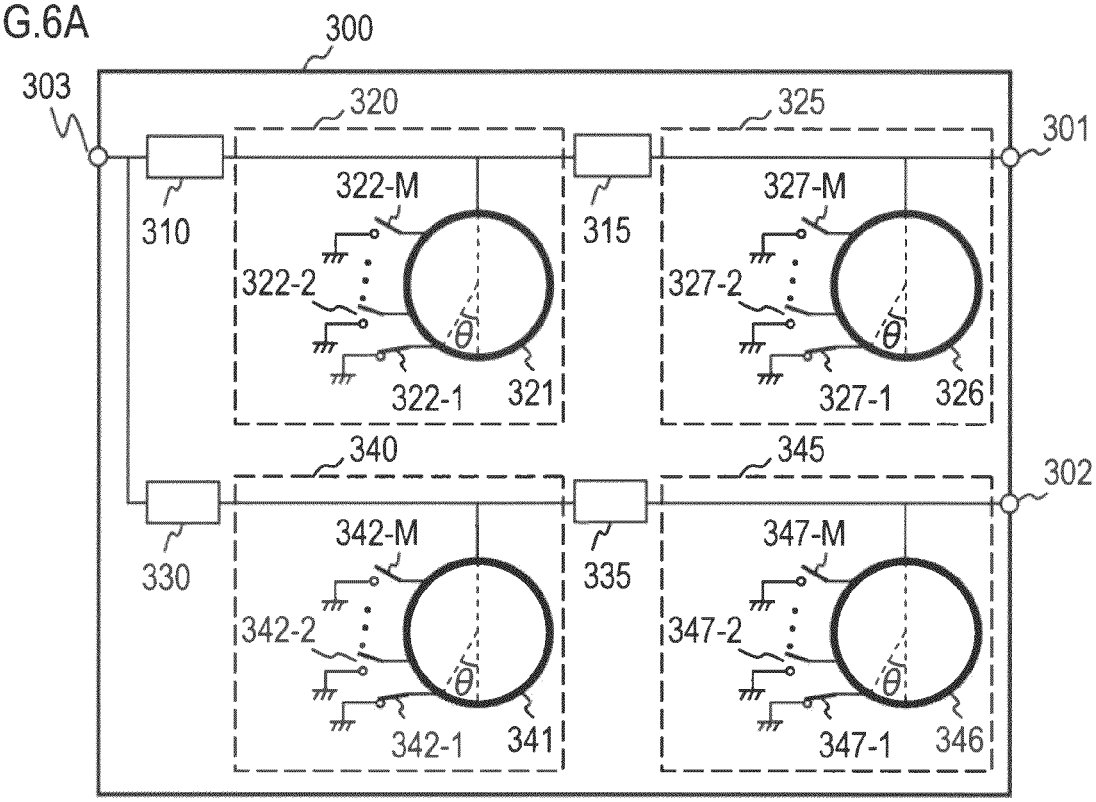
FIG. 6A shows an exemplary functional configuration of a duplexer in which two resonating parts having switches each connected to a ground conductor at one end are provided for each path.
Figure 6B:
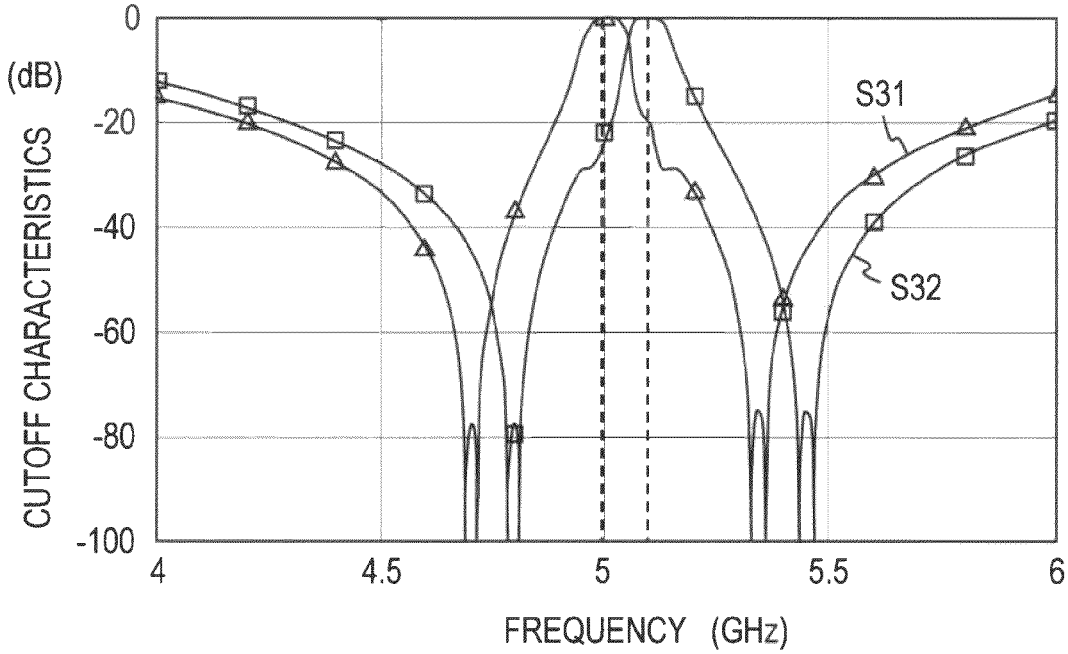
FIG. 6B is a graph showing frequency characteristics of the duplexer having the functional configuration shown in FIG. 6A.
Figure 7A:
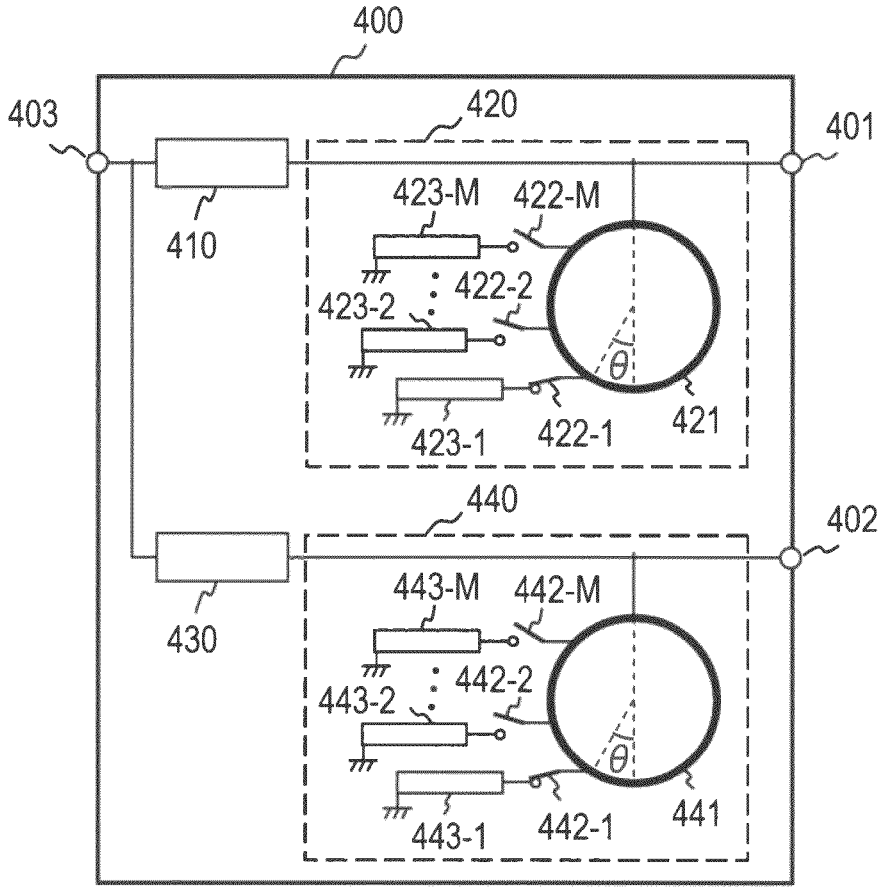
FIG. 7A shows an exemplary functional configuration of a duplexer in which one resonating part having switches each connected to a passive circuit is provided for each path.
Figure 7B:
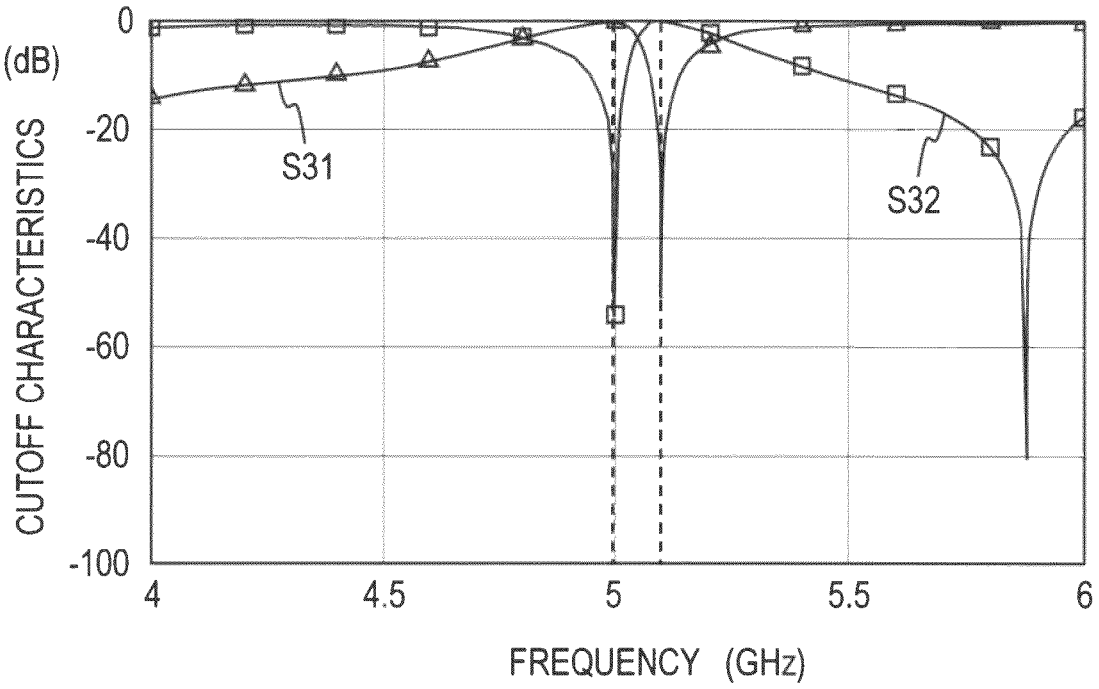
FIG. 7B is a graph showing frequency characteristics of the duplexer having the functional configuration shown in FIG. 7A.

In an embodiment 2, three types of duplexers will be shown, and characteristics thereof will be described. FIG. 5A shows an exemplary functional configuration of a duplexer in a case where one resonating part having switches each connected to a ground conductor at one end is provided for each path. FIG. 5B is a graph showing frequency characteristics of the duplexer having the functional configuration shown in FIG. 5A. FIG. 6A shows an exemplary functional configuration of a duplexer in a case where two phase shifting parts and two resonating parts having switches each connected to a ground conductor at one end are provided for each path. FIG. 6B is a graph showing frequency characteristics of the duplexer having the functional configuration shown in FIG. 6A. FIG. 7A shows an exemplary functional configuration of a duplexer in a case where one resonating part having switches each connected to a passive circuit is provided for each path. FIG. 7B is a graph showing frequency characteristics of the duplexer having the functional configuration shown in FIG. 7A.

A duplexer 200 shown in FIG. 5A has a first port 201, a second port 202 and a third port 203 for external input/output. A first path is formed between the first port 201 and the third port 203, and a second path is formed between the second port 202 and the third port 203. The first and second paths include phase shifting parts 210 and 230 and resonating part 220 and 240, respectively. The resonating parts 220 and 240 have ring conductors 221 and 241 having a length equal to one wavelength at a resonant frequency or an integral multiple thereof and a plurality of switches 222-1 to 222-M and 242-1 to 242-M, respectively, each of the switches 222-1 to 222-M is connected to a different part of the ring conductor 221 at one end and to a ground conductor at the other end, and each of the switches 242-1 to 242-M is connected to a different part of the ring conductor 241 at one end and to a ground conductor at the other end. The resonating parts 220 and 240 may have different numbers of switches.

A duplexer 300 shown in FIG. 6A has a first port 301, a second port 302 and a third port 303 for external input/output. A first path is formed between the first port 301 and the third port 303, and a second path is formed between the second port 302 and the third port 303. The first path and the second path include two sets of phase shifting parts 310 and 315 and resonating parts 320 and 325 and two sets of phase shifting parts 330 and 335 and resonating parts 340 and 345, respectively. The resonating parts 320, 325, 340 and 345 have ring conductors 321, 326, 341 and 346 having a length equal to one wavelength at a resonant frequency or an integral multiple thereof and a plurality of switches 322-1 to 322-M, 327-1 to 327-M, 342-1 to 342-M and 347-1 to 347-M, respectively, each of the switches 322-1 to 322-M is connected to a different part of the ring conductor 321 at one end and to a ground conductor at the other end, each of the switches 327-1 to 327-M is connected to a different part of the ring conductor 326 at one end and to a ground conductor at the other end, each of the switches 342-1 to 342-M is connected to a different part of the ring conductor 341 at one end and to a ground conductor at the other end, and each of the switches 347-1 to 347-M is connected to a different part of the ring conductor 346 at one end and to a ground conductor at the other end. The resonating parts 320, 325, 340 and 345 may have different numbers of switches.

A duplexer 400 shown in FIG. 7A has a first port 401, a second port 402 and a third port 403 for external input/output. A first path is formed between the first port 401 and the third port 403, and a second path is formed between the second port 402 and the third port 403. The first path includes a phase shifting part 410 and a resonating part 420, and the second path includes a phase shifting part 430 and a resonating part 440. The resonating parts 420 and 440 have ring conductors 421 and 441 having a length equal to one wavelength at a resonant frequency or an integral multiple thereof, a plurality of passive circuits 423-1 to 423-M and 443-1 to 443-M, and a plurality of switches 422-1 to 422-M and 442-1 to 442-M, respectively, each of the switches 422-1 to 422-M is connected to a different part of the ring conductor 421 at one end and to any of the passive circuits 423-1 to 423-M at the other end, and each of the switches 442-1 to 442-M is connected to a different part of the ring conductor 441 at one end and to any of the passive circuits 443-1 to 443-M at the other end. The resonating parts 420 and 440 may have different numbers of switches.

As an example, a duplexer that separates 5 GHz and 5.1 GHz will be considered. The first path is supposed to permit passage of signals having a fractional bandwidth of 1.8% with respect to a center frequency of 5 GHz, and the second path is supposed to permit passage of signals having a fractional bandwidth of 1.8% with respect to a center frequency of 5.1 GHz. That is, the resonant frequency of the resonating parts 220, 320, 325 and 420 in the first path of the duplexers 200, 300 and 400 is set at 5 GHz, and the resonant frequency of the resonating parts 240, 340, 345 and 440 in the second path of the duplexers is set at 5.1 GHz. Furthermore, the passive circuits 423-1 to 423-M have an electrical length of 20° at the frequency of 5 GHz, and the passive circuits 443-1 to 443-M have an electrical length of 20° at the frequency of 5.1 GHz.

In FIGS. 5B, 6B and 7B, the cutoff characteristics of the first path (the cutoff characteristics from the third port to the first port) is denoted by S31, and the cutoff characteristics of the second path (the cutoff characteristics from the third port to the second port) is denoted by S32. As shown in FIG. 5B, the cutoff characteristics S31 of the first path in the duplexer 200 is approximately 0 dB at 5 GHz and approximately 10 dB at 5.1 GHz. The cutoff characteristics S32 of the second path is approximately 10 dB at 5 GHz and approximately 0 dB at 5.1 GHz. As shown in FIG. 6B, the cutoff characteristics S31 of the first path in the duplexer 300 is approximately 0 dB at 5 GHz and approximately 20 dB at 5.1 GHz because the first path in the duplexer 300 includes two resonating parts. The cutoff characteristics S32 of the second path is approximately 20 dB at 5 GHz and approximately 0 dB at 5.1 GHz. In this way, the signal at the frequency that is desirably to be cut off can be attenuated by increasing the number of resonating parts. As shown in FIG. 7B, the cutoff characteristics S31 of the first path in the duplexer 400 is approximately 0 dB at 5 GHz and approximately 50 dB (transmission zero) at 5.1 GHz. The cutoff characteristics S32 of the second path is approximately 50 dB (transmission zero) at 5 GHz and approximately 0 dB at 5.1 GHz. In this way, if the passive circuits 423-1 to 423-M and 443-1 to 443-M are used, the frequency characteristics can be biased, so that the desired frequency characteristics can be more easily achieved.

As described above, any of the duplexers according to this embodiment can change the bandwidth and the in-band and out-band characteristics of the resonating parts by selecting from among the switches. That is, the frequency characteristics of the filter can be changed. Furthermore, if the passive circuits are used, the frequency characteristics can be more easily biased, so that the number of resonating parts can be reduced, and downsizing of the duplexers can expected.

The type of duplexer to be used and the number of resonating parts can be appropriately determined based on the required frequency characteristics. For example, even a duplexer having a passive circuit can have a plurality of resonators in a path when the high cutoff characteristics is required outside of the band.

Embodiment 3

Figure 8:
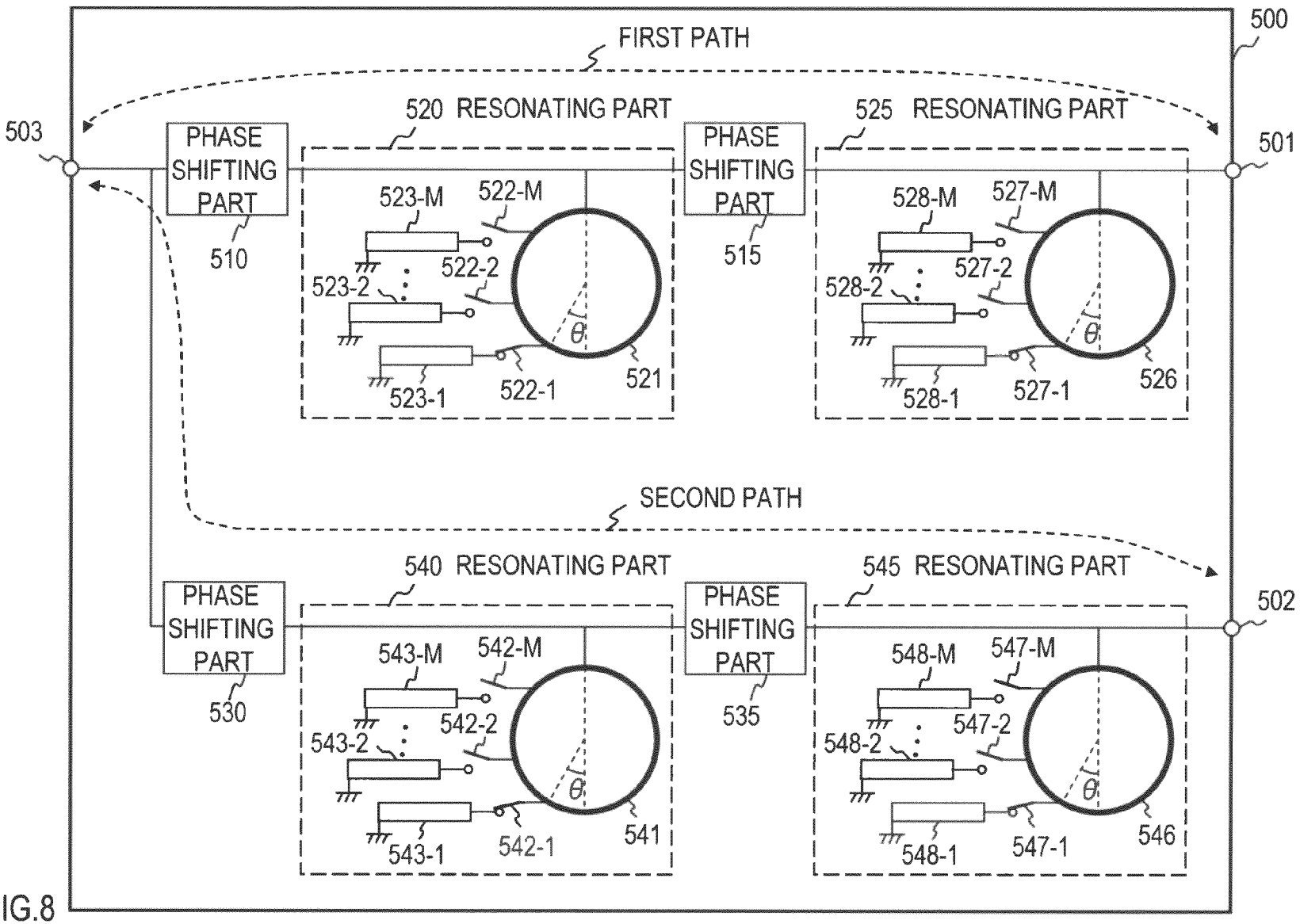
FIG. 8 is a diagram showing an exemplary configuration of a duplexer according to an embodiment 3.

FIG. 8 shows an exemplary configuration of a duplexer according to an embodiment 3. A duplexer 500 has a first port 501, a second port 502 and a third port 503 for external input/output. A first path is formed between the first port 501 and the third port 503, and a second path is formed between the second port 502 and the third port 503. The first path includes a phase shifting part 510, a resonating part 520, a phase shifting part 515 and a resonating part 525, and the second path includes a phase shifting part 530, a resonating part 540, a phase shifting part 535 and a resonating part 545. The resonating parts 520, 525, 540 and 545 have ring conductors 521, 526, 541 and 546 having a length equal to one wavelength at a resonant frequency or an integral multiple thereof, a plurality of passive circuits 523-1 to 523-M, 528-1 to 528-M, 543-1 to 543-M and 548-1 to 548-M, and a plurality of switches 522-1 to 522-M, 527-1 to 527-M, 542-1 to 542-M and 547-1 to 547-M, respectively, each of the switches 522-1 to 522-M is connected to a different part of the ring conductor 521 at one end and to any of the passive circuits 523-1 to 523-M at the other end, each of the switches 527-1 to 527-M is connected to a different part of the ring conductor 526 at one end and to any of the passive circuits 528-1 to 528-M at the other end, each of the switches 542-1 to 542-M is connected to a different part of the ring conductor 541 at one end and to any of the passive circuits 543-1 to 543-M at the other end, and each of the switches 547-1 to 547-M is connected to a different part of the ring conductor 546 at one end and to any of the passive circuits 548-1 to 548-M at the other end. The resonating parts 520, 525, 540 and 545 may have different numbers of switches.

The duplexer 500 has two resonating parts in each path. With such a configuration, even a strict requirement on the cutoff characteristics can be more easily satisfied. Therefore, even if the requirement on the cutoff characteristics is strict, the circuit area and the number of components can be reduced.

Embodiment 4

Figure 9:
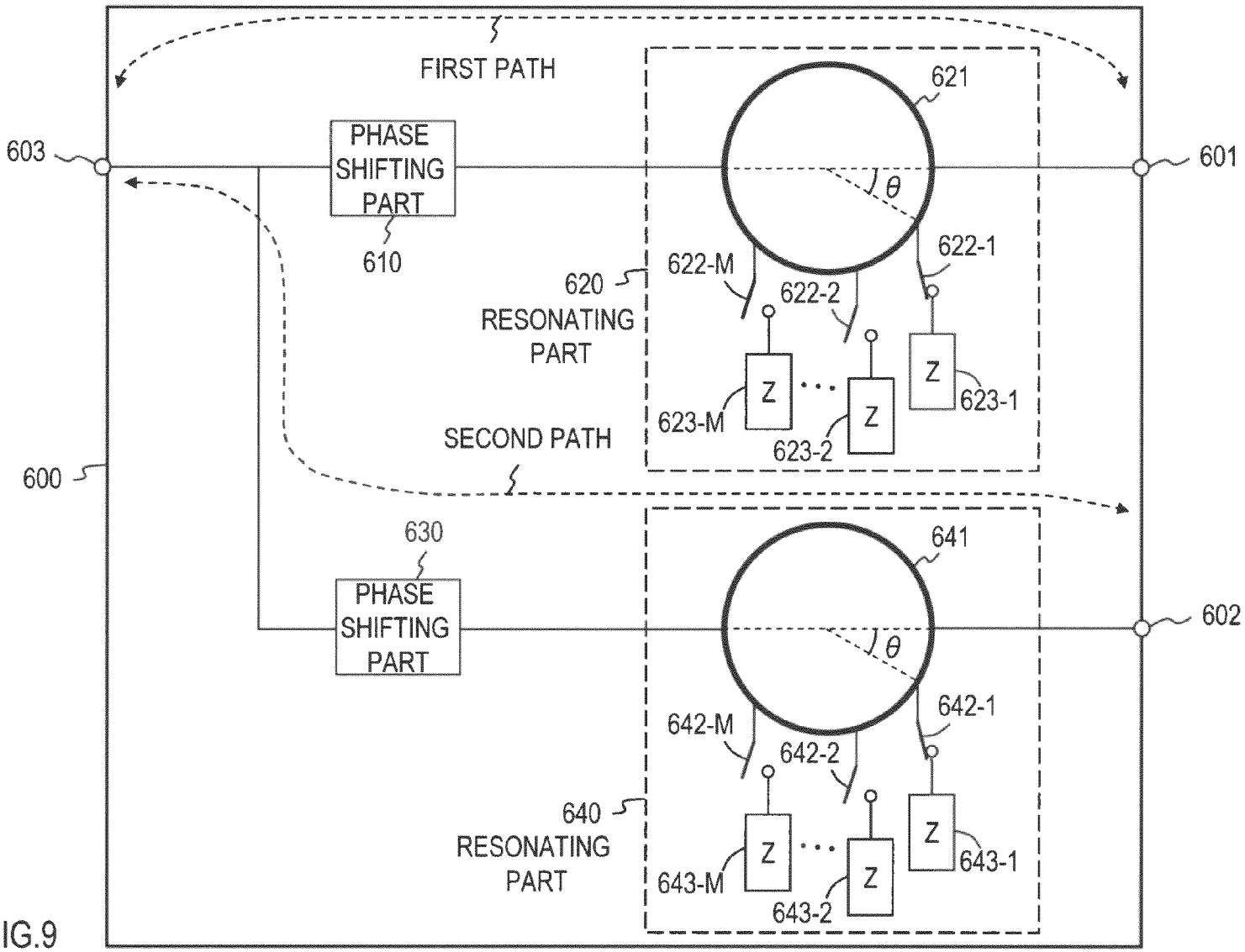
FIG. 9 is a diagram showing an exemplary configuration of a duplexer according to an embodiment 4.

FIG. 9 shows an exemplary configuration of a duplexer according to an embodiment 4. In the embodiments 1 to 3, input to and output from the ring conductor occur at the same position. On the other hand, in a duplexer 600, input to and output from a ring conductor occur at different positions apart from each other by 180°. However, the duplexer 600 is composed of the same parts as those of the duplexer 400. The duplexer 600 has a first port 601, a second port 602 and a third port 603 for external input/output. A first path is formed between the first port 601 and the third port 603, and a second path is formed between the second port 602 and the third port 603. The first path includes a phase shifting part 610 and a resonating part 620, and the second path includes a phase shifting part 630 and a resonating part 640. The resonating parts 620 and 640 have ring conductors 621 and 641 having a length equal to one wavelength at a resonant frequency or an integral multiple thereof, a plurality of passive circuits 623-1 to 623-M and 643-1 to 643-M, and a plurality of switches 622-1 to 622-M and 642-1 to 642-M, respectively, each of the switches 622-1 to 622-M is connected to a different part of the ring conductor 621 at one end and to any of the passive circuits 623-1 to 623-M at the other end, and each of the switches 642-1 to 642-M is connected to a different part of the ring conductor 641 at one end and to any of the passive circuits 643-1 to 643-M at the other end. The resonating parts 620 and 640 may have different numbers of switches. Furthermore, each path may include a plurality of sets of phase shifting parts and resonating parts.

As in the embodiments 1 to 3, the circuit area and the number of components of the duplexer 600 can also be reduced.

Embodiment 5

Figure 10:
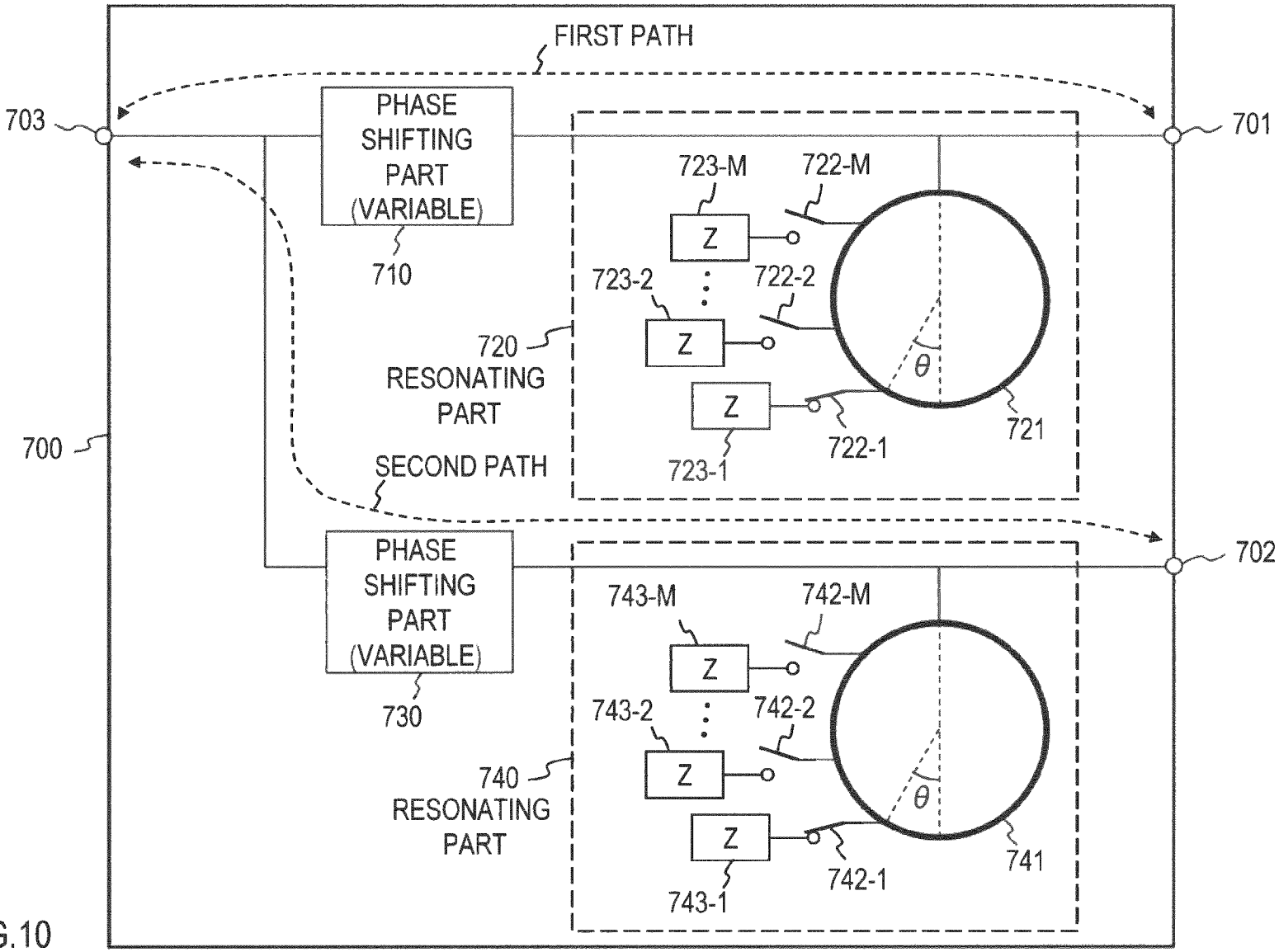
FIG. 10 is a diagram showing an exemplary configuration of a duplexer according to an embodiment 5.

FIG. 10 shows an exemplary configuration of a duplexer according to an embodiment 5. A duplexer 700 differs from the duplexer 400 in that characteristics of phase shifting parts 710 and 730 can be changed. However, the duplexer 700 is composed of the same parts as those of the duplexer 400. The duplexer 700 has a first port 701, a second port 702 and a third port 703 for external input/output. A first path is formed between the first port 701 and the third port 703, and a second path is formed between the second port 702 and the third port 703. The first path includes the phase shifting part 710 having variable characteristics and a resonating part 720, and the second path includes a phase shifting part 730 having variable characteristics and a resonating part 740. The resonating parts 720 and 740 have ring conductors 721 and 741 having a length equal to one wavelength at a resonant frequency or an integral multiple thereof, a plurality of passive circuits 723-1 to 723-M and 743-1 to 743-M, and a plurality of switches 722-1 to 722-M and 742-1 to 742-M, respectively, each of the switches 722-1 to 722-M is connected to a different part of the ring conductor 721 at one end and to any of the passive circuits 723-1 to 723-M at the other end, and each of the switches 742-1 to 742-M is connected to a different part of the ring conductor 741 at one end and to any of the passive circuits 743-1 to 743-M at the other end.

When the switch in the on state is changed, or the characteristics of the passive circuit are changed, the input impedance of the first path or the second path can be shifted from infinity, and the loss in the pass band can increase. Even when such a situation occurs, if the phase shifting parts 710 and 730 have variable characteristics, the impedance can be adjusted to be infinity to reduce the loss by changing the characteristics of the phase shifting parts 710 and 730.

Embodiment 6

Figure 11C:
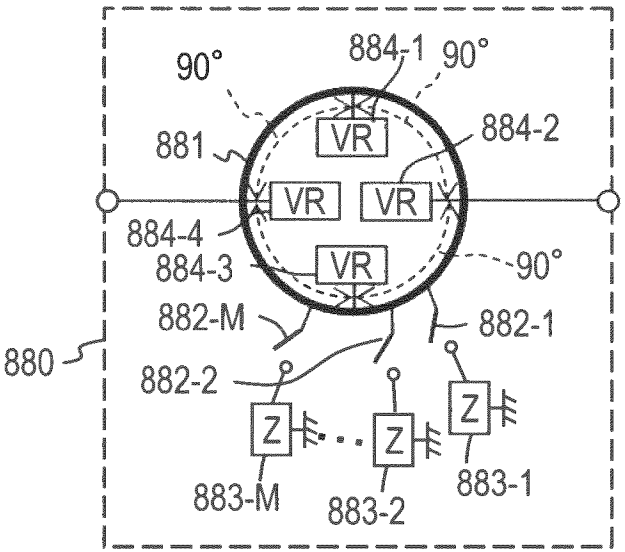
FIG. 11C is a diagram showing an exemplary configuration of a resonating part capable of changing the resonant frequency in which four variable reactance means are connected at regular intervals to a ring conductor having an input and an output apart from each other by 180°.
Figure 11A:
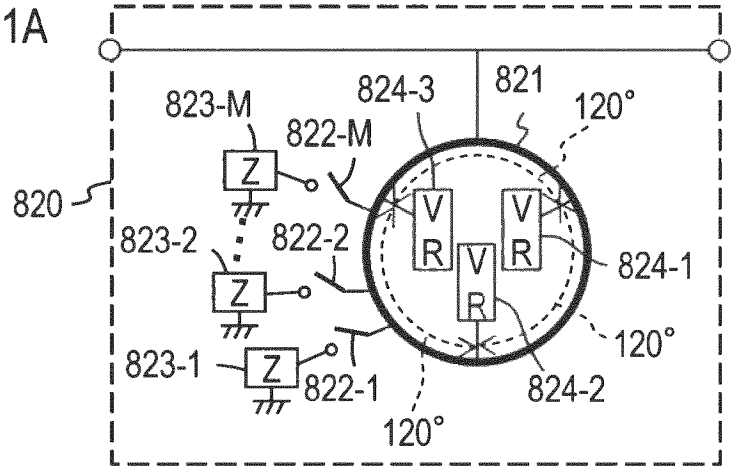
FIG. 11A is a diagram showing an exemplary configuration of a resonating part capable of changing the resonant frequency in which three variable reactance means are connected at regular intervals to a ring conductor.
Figure 11B:
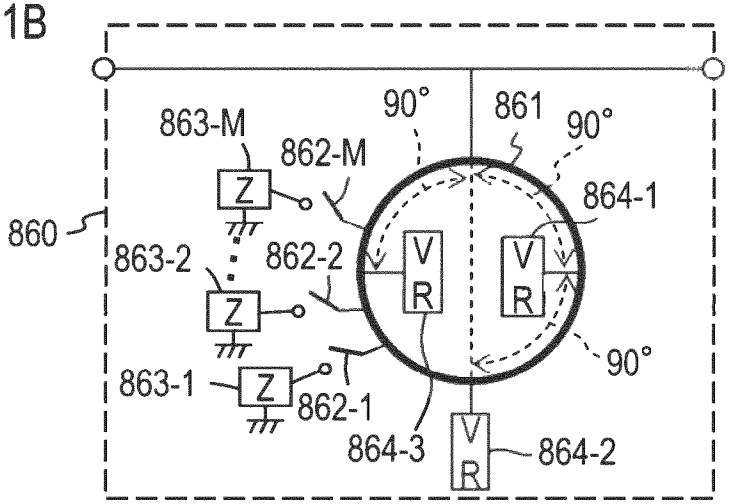
FIG. 11B is a diagram showing an exemplary configuration of a resonating part capable of changing the resonant frequency in which three variable reactance means are connected at intervals of 90° to a ring conductor.

The duplexers according to the embodiments 1 to 5 described above have a fixed frequency band. In an embodiment 6, a case where the frequency band of a duplexer is changed will be described. In this case, the resonant frequency of a resonating part has to be changed. FIG. 11A is a diagram showing an exemplary configuration of a resonating part capable of changing the resonant frequency in which three variable reactance means are connected at regular intervals to a ring conductor. FIG. 11B is a diagram showing an exemplary configuration of a resonating part capable of changing the resonant frequency in which three variable reactance means are connected at intervals of 90° to a ring conductor. FIG. 11C is a diagram showing an exemplary configuration of a resonating part capable of changing the resonant frequency in which four variable reactance means are connected at regular intervals to a ring conductor having an input and an output apart from each other by 180°. However, the resonating part may have five or more variable reactance means. The resonating parts 820, 860 and 880 can change the resonant frequency by changing the reactance of the variable reactance means 824-1 to 824-3, 864-1 to 864-3, and 884-1 to 884-4, respectively. The variable reactance means 824-1 to 824-3 change the respective reactances while making the reactances agree with each other. The variable reactance means 864-2 changes the reactance in such a manner that the reactance is a half of the reactance of the variable reactance means 864-1 and 864-3. The variable reactance means 884-1 to 884-4 change the respective reactances while making the reactances agree with each other. When the switch in the on state is changed, the position of the transmission zero and the susceptance slope parameter change. However, in this process, the resonant frequency does not change. Thus, the resonant frequency is determined by the value of the reactance of the variable reactance means.

Figure 12:
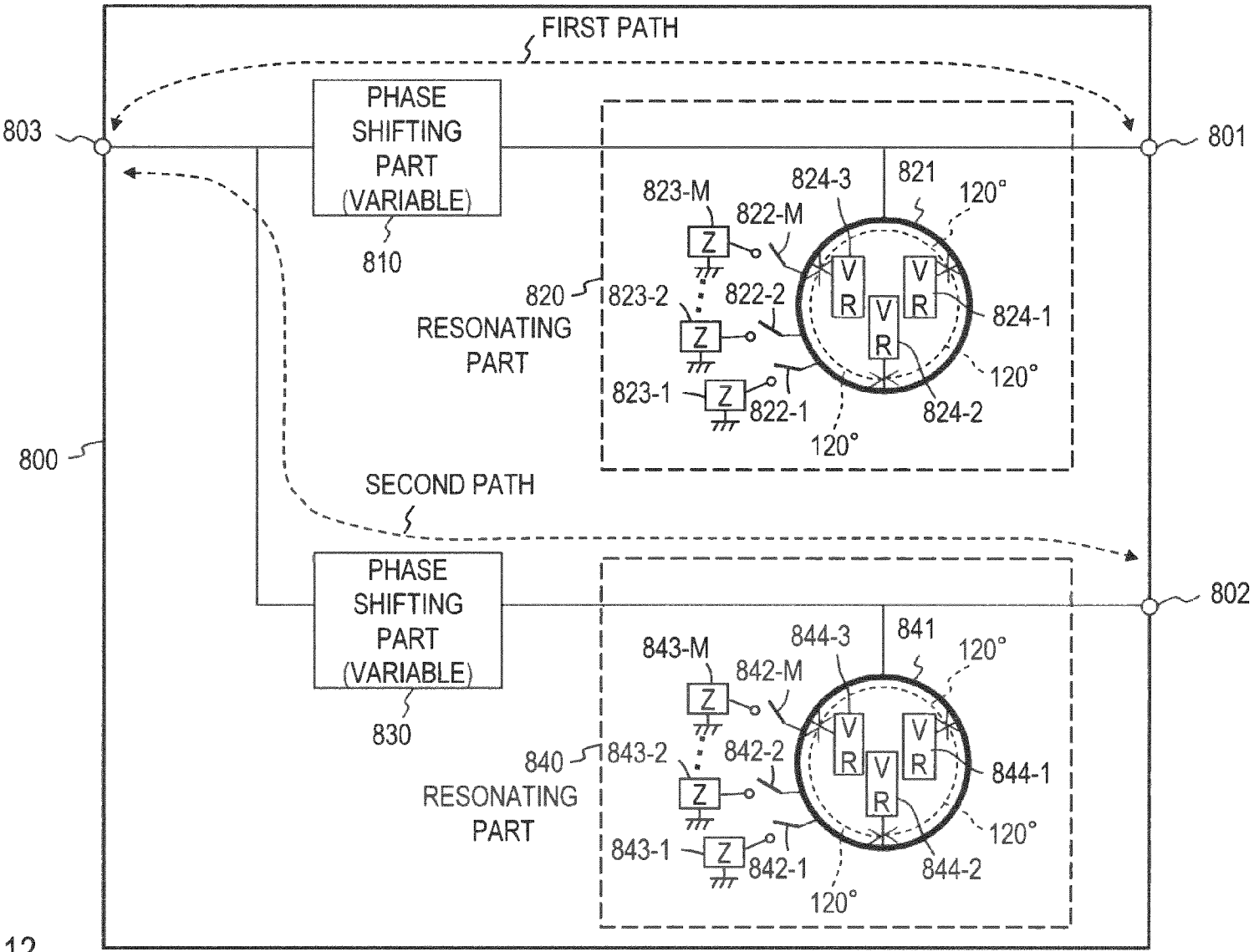
FIG. 12 is a diagram showing an exemplary configuration of a duplexer according to an embodiment 6.

FIG. 12 shows an exemplary configuration of a duplexer that includes resonating parts having variable reactance means. A duplexer 800 has a first port 801, a second port 802 and a third port 803 for external input/output. A first path is formed between the first port 801 and the third port 803, and a second path is formed between the second port 802 and the third port 803. The first path includes a phase shifting part 810 having variable characteristics and a resonating part 820, and the second path includes a phase shifting part 830 having variable characteristics and a resonating part 840. The resonating parts 820 and 840 have ring conductors 821 and 841 having a length equal to one wavelength at a resonant frequency or an integral multiple thereof, a plurality of passive circuits 823-1 to 823-M and 843-1 to 843-M, a plurality of switches 822-1 to 822-M and 842-1 to 842-M, each of the switches 822-1 to 822-M being connected to a different part of the ring conductor 821 at one end and to any of the passive circuits 823-1 to 823-M at the other end, and each of the switches 842-1 to 842-M being connected to a different part of the ring conductor 841 at one end and to any of the passive circuits 843-1 to 843-M at the other end, and three variable reactance means each connected to a different part of the ring conductors 821 and 841, respectively. The resonating parts 820 and 840 may have different numbers of switches.

In order to cut off the signal to be cut off even when the frequency band for transmission and reception is significantly changed, the phase shifting parts 810 and 830 having variable characteristics each change the characteristics to always maintain a high input impedance to the signals in the frequency band of the other path. When the variation of the frequency band is small, the input impedance does not significantly change, so that the phase shifting parts 810 and 830 can have fixed characteristics (phase shifting parts having fixed characteristics can be used). The resonating parts shown in FIGS. 11B and 11C can also be used. Alternatively, a path may include a plurality of sets of phase shifting parts and resonating parts. In the case where a path includes a plurality of sets of phase shifting parts and resonating parts, the phase shifting parts desirably have variable characteristics when the frequency band is significantly changed.

The duplexer 800 thus configured has not only the same advantages as in the other embodiments that the circuit area and the number of components can be reduced but also an advantage that the frequency band for transmission and reception (the center frequency) can be changed.

Figure 13B:
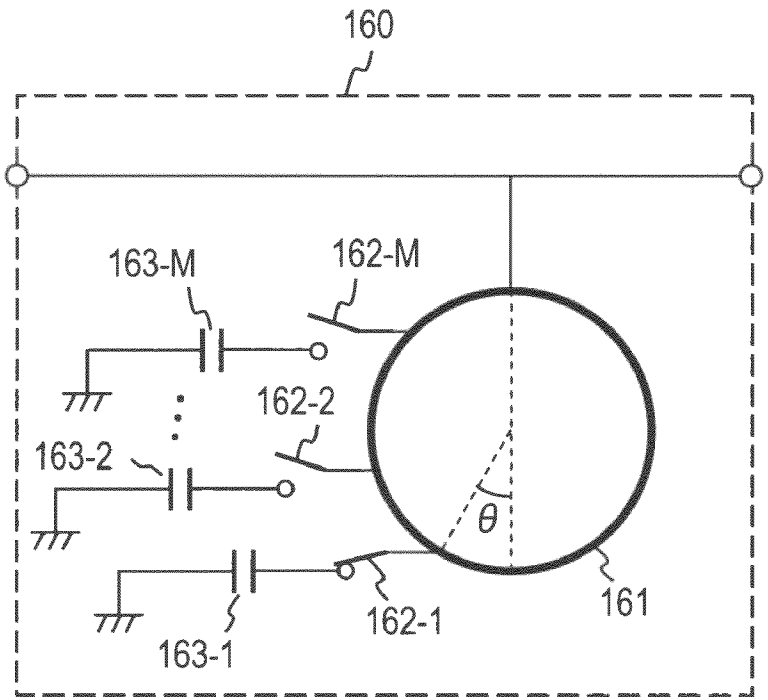
FIG. 13B is a diagram showing a modification of the passive circuit described in the embodiments 1 to 6, in which a capacitor is used as the passive circuit.
Figure 13A:
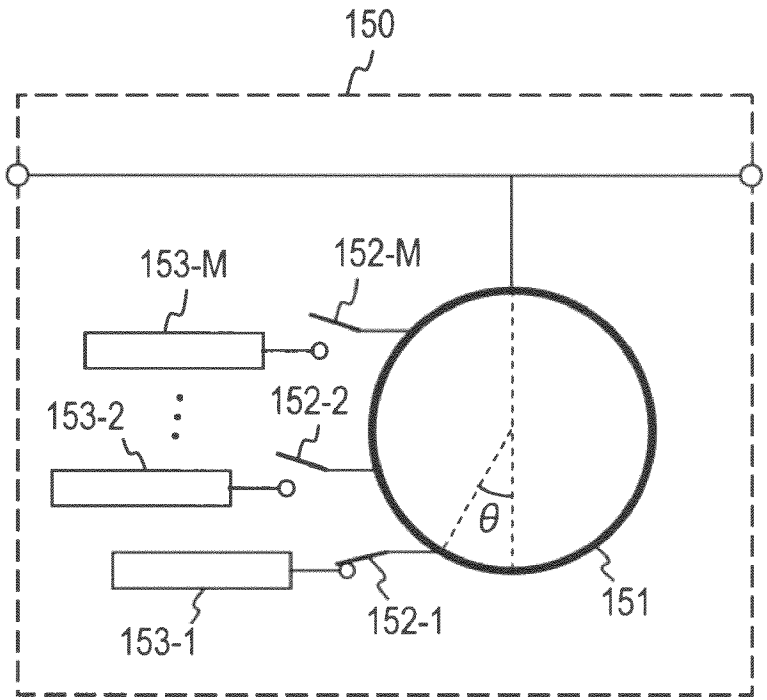
FIG. 13A is a diagram showing a modification of the passive circuit described in the embodiments 1 to 6, in which a line having an open end is used as the passive circuit.

FIG. 13A is a diagram showing a modification of the passive circuit described in the embodiments 1 to 6, in which a line having an open end is used as the passive circuit. FIG. 13B is a diagram showing a modification of the passive circuit described in the embodiments 1 to 6, in which a capacitor is used as the passive circuit. A resonating part 150 has a ring conductor 151 having a length equal to one wavelength at a resonant frequency or an integral multiple thereof, a plurality of passive circuits (lines having an open end) 153-1 to 153-M, and a plurality of switches 152-1 to 152-M each of which is connected to a different part of the ring conductor 151 at one end and to any of the passive circuits (lines having an open end) 153-1 to 153-M at the other end. A resonating part 160 has a ring conductor 161 having a length equal to one wavelength at a resonant frequency or an integral multiple thereof, a plurality of passive circuits (capacitors) 163-1 to 163-M, and a plurality of switches 162-1 to 162-M each of which is connected to a different part of the ring conductor 161 at one end and to any of the passive circuits (capacitors) 163-1 to 163-M at the other end.

Although not shown, a coil or a combination of the passive circuits (elements) described above may be used. In particular, the frequency characteristics can be more easily biased if the passive circuits have a reactance component (an imaginary component of an impedance, such as a capacitance and an inductance).

Embodiment 7

Figure 14:
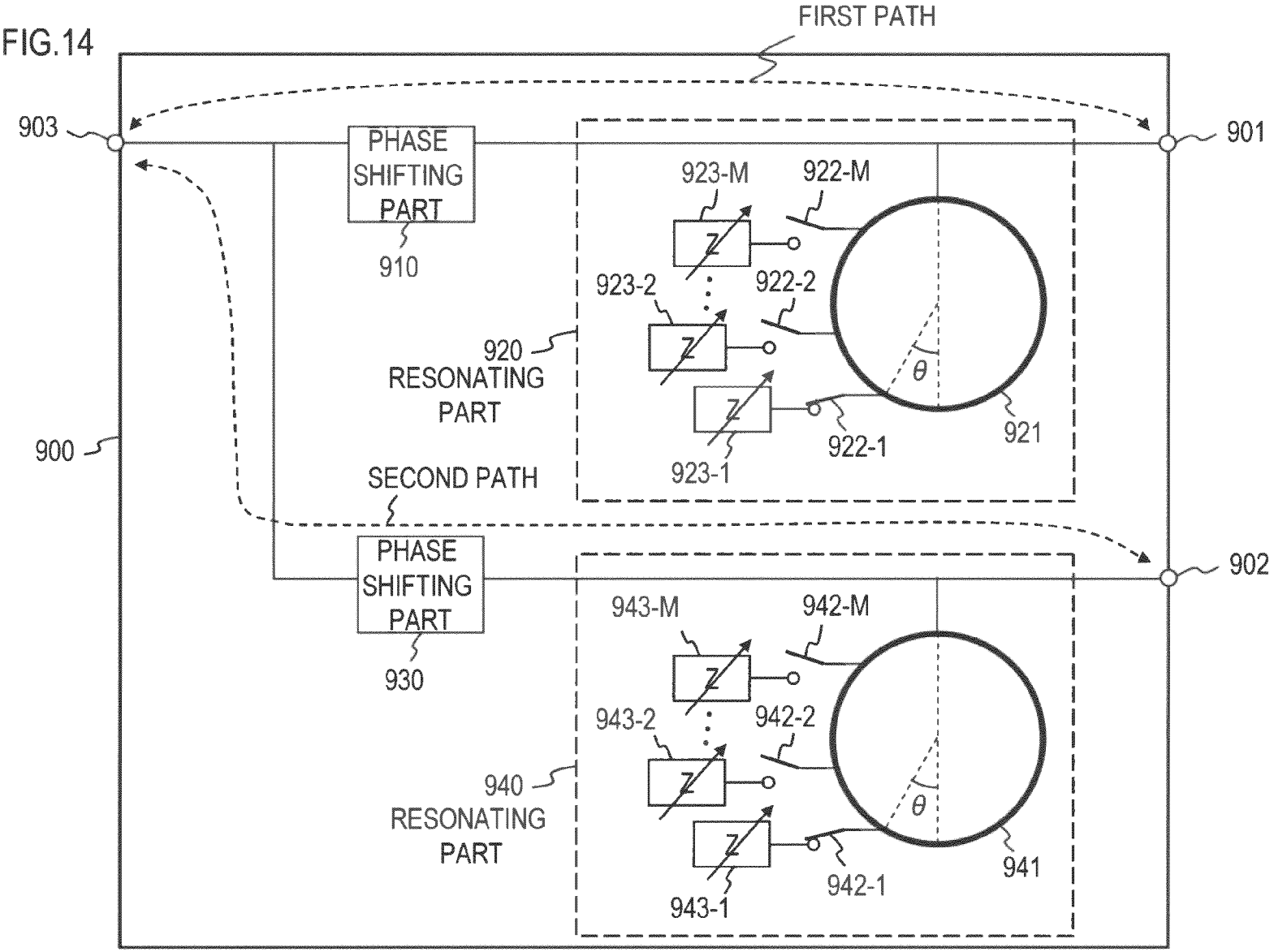
FIG. 14 is a diagram showing an exemplary configuration of a duplexer according to an embodiment 7.
Figure 15C:
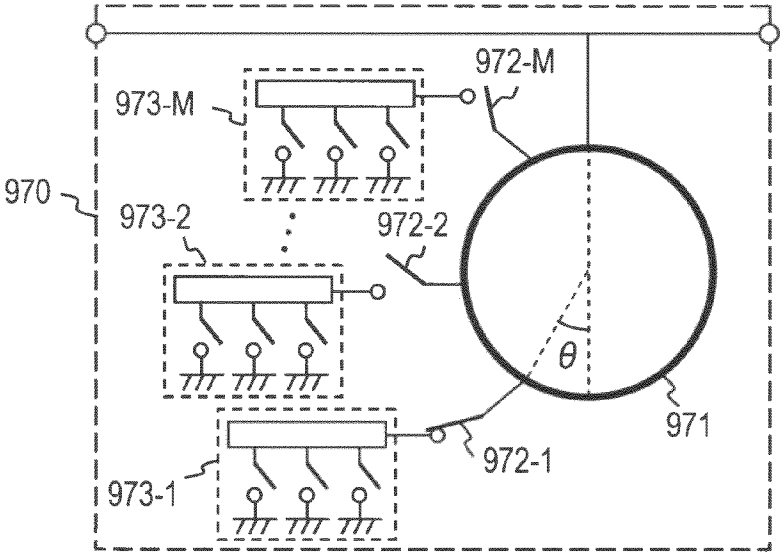
FIG. 15C is a diagram showing an example in which passive circuits having variable characteristics are composed of a line that can be short-circuited at different points by different switches.
Figure 15D:
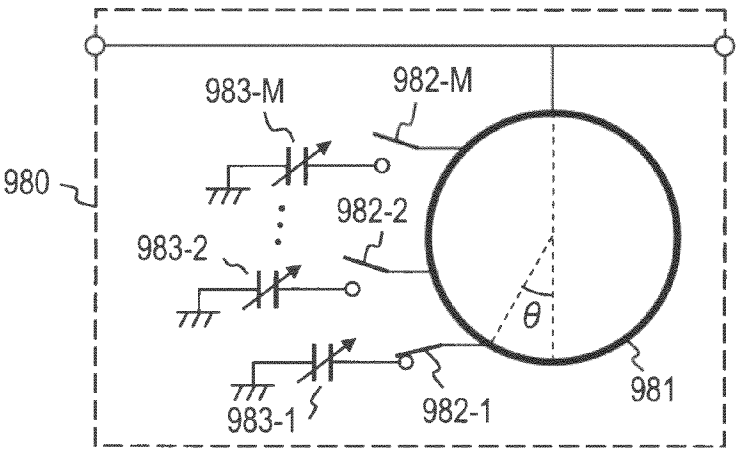
FIG. 15D is a diagram showing an example in which passive circuits having variable characteristics have a variable capacitor.
Figure 15A:
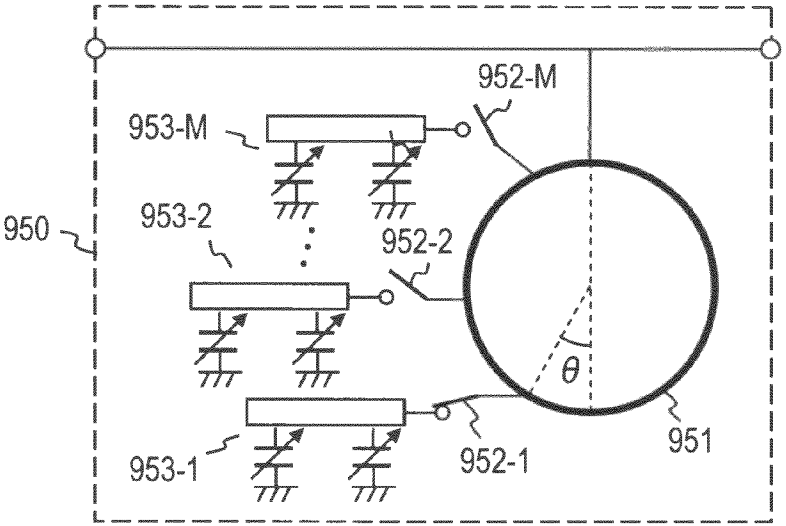
FIG. 15A is a diagram showing a specific example in which passive circuits having variable characteristics are composed of a line having an open end and variable capacitors connected thereto.
Figure 15B:
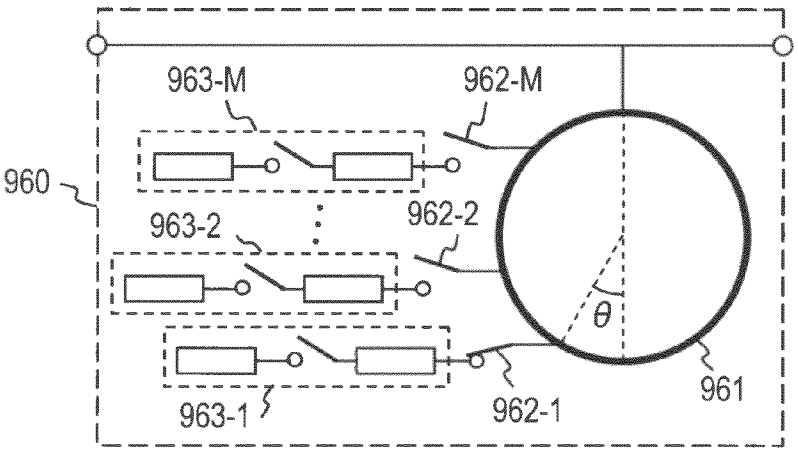
FIG. 15B is a diagram showing an example in which passive circuits having variable characteristics are composed of a plurality of lines connected in series by switches.

FIG. 14 shows an exemplary configuration of a duplexer according to an embodiment 7. A duplexer 900 differs from the duplexer 400 according to the embodiment 2 (shown in FIG. 7) in that the passive circuits have variable characteristics. Alternatively, the duplexer 600 according to the embodiment 4 (shown in FIG. 9) can have passive circuits having variable characteristics. The duplexer 900 has a first port 901, a second port 902 and a third port 903 for external input/output. A first path is formed between the first port 901 and the third port 903, and a second path is formed between the second port 902 and the third port 903. The first path includes a phase shifting part 910 and a resonating part 920, and the second path includes a phase shifting part 930 and a resonating part 940. The resonating parts 920 and 940 have ring conductors 921 and 941 having a length equal to one wavelength at a resonant frequency or an integral multiple thereof, a plurality of passive circuits 923-1 to 923-M and 943-1 to 943-M having variable characteristics, and a plurality of switches 922-1 to 922-M and 942-1 to 942-M, each of the switches 922-1 to 922-M is connected to a different part of the ring conductor 921 at one end and to any of the passive circuits 923-1 to 923-M at the other end, and each of the switches 942-1 to 942-M is connected to a different part of the ring conductor 941 at one end and to any of the passive circuits 943-1 to 943-M at the other end. The resonating parts 920 and 940 may have different numbers of switches.

FIG. 15 show specific examples of the passive circuit having variable characteristics. FIG. 15A is a diagram showing an example in which passive circuits having variable characteristics are composed of a line having an open end and variable capacitors connected thereto. FIG. 15B is a diagram showing an example in which passive circuits having variable characteristics are composed of a plurality of lines connected in series by switches. FIG. 15C is a diagram showing an example in which passive circuits having variable characteristics are composed of a line that can be short-circuited at different points by different switches. FIG. 15D is a diagram showing an example in which passive circuits having variable characteristics have a variable capacitor. These passive circuits can also be used in combination. Bias of the frequency characteristics of the resonating part can be adjusted by changing the characteristics of the passive circuits. Thus, these configurations are advantageous in a case where changing the position of the transmission zero is desirable (a case of changing the frequency permitted by the other path to pass), for example.

Figure 16B:
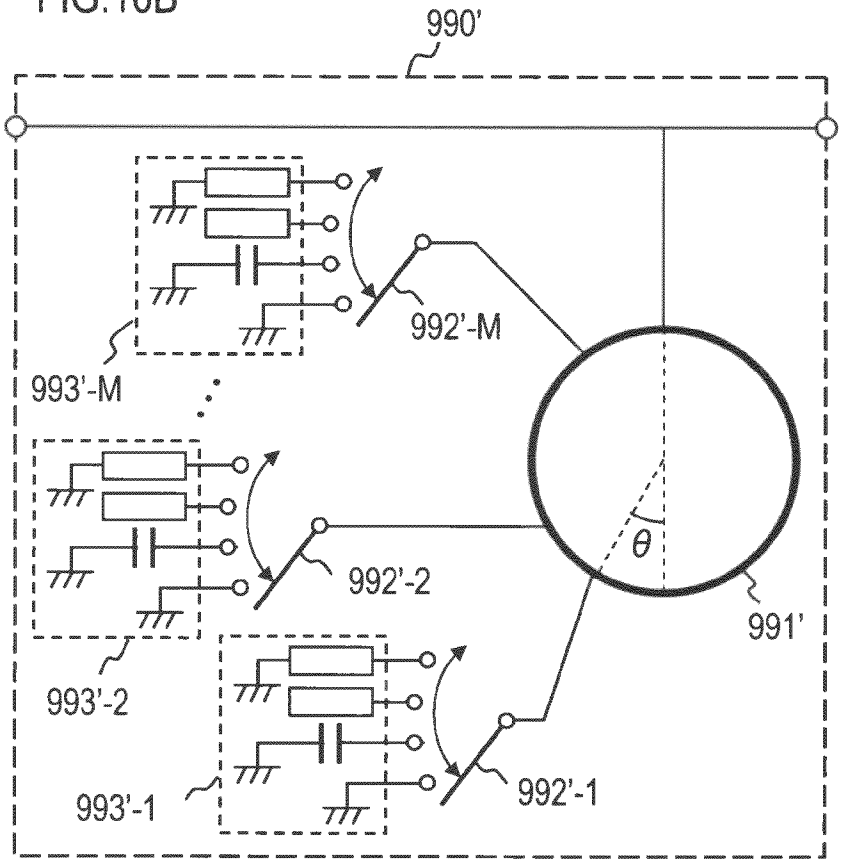
FIG. 16B is a diagram showing an example of a resonating part that selects one from among passive circuits and a terminal connected to a ground conductor using a switch.
Figure 16A:
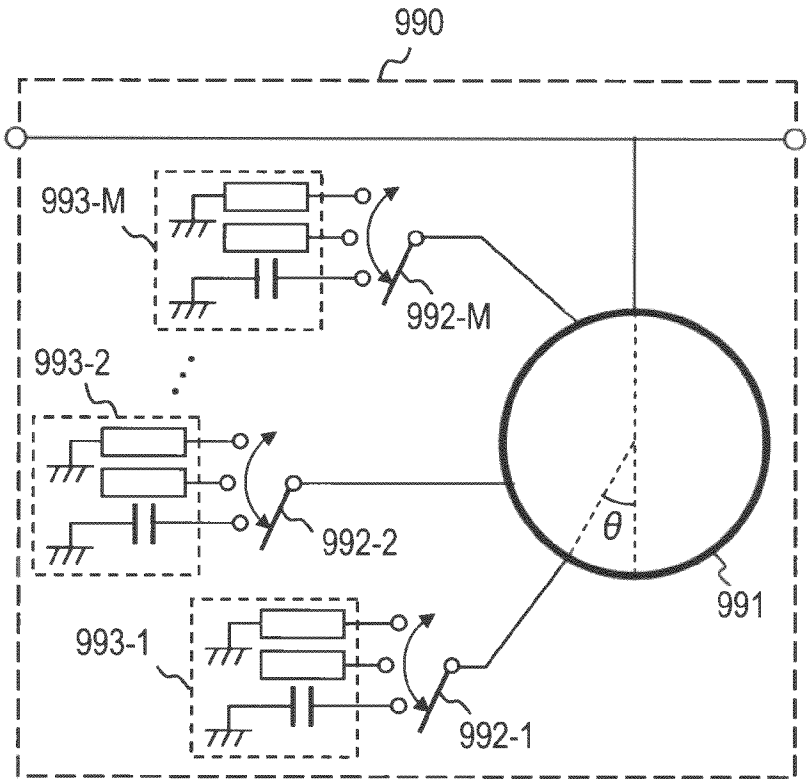
FIG. 16A is a diagram showing an example of a resonating part that selects one from among passive circuits using a switch.

Alternatively, the resonating part may be configured to select from among several passive circuits using a switch. FIG. 16A shows an example in which one of three passive circuits is selected using a switch, and FIG. 16B shows an example in which a terminal connected to a ground conductor is further included as an option. A resonating part 990 has a ring conductor 991 having a length equal to one wavelength at a resonant frequency or an integral multiple thereof, a plurality of passive circuits (a plurality of sets of passive circuits including a plurality of kinds of passive circuits) 993-1 to 993-M, and a plurality of switches 992-1 to 992-M, each of which is connected to a different part of the ring conductor 991 at one end and to any of the passive circuits (the plurality of sets of passive circuits including a plurality of kinds of passive circuits) 993-1 to 993-M at the other end to select one from the set of passive circuits. A resonating part 990' is the same as the resonating part 990 except that the set of a plurality of passive circuits includes a terminal connected to a ground conductor. The frequency characteristics can be more easily biased if the impedance of the passive circuit includes a reactance component (an imaginary component of an impedance, such as a capacitance and an inductance).

The duplexer according to this embodiment can also be reduced in circuit area and number of components. In addition, since the characteristics of the passive circuits can be changed, bias of the frequency characteristics of the resonating parts can be adjusted.

Embodiment 8

Figure 17A:
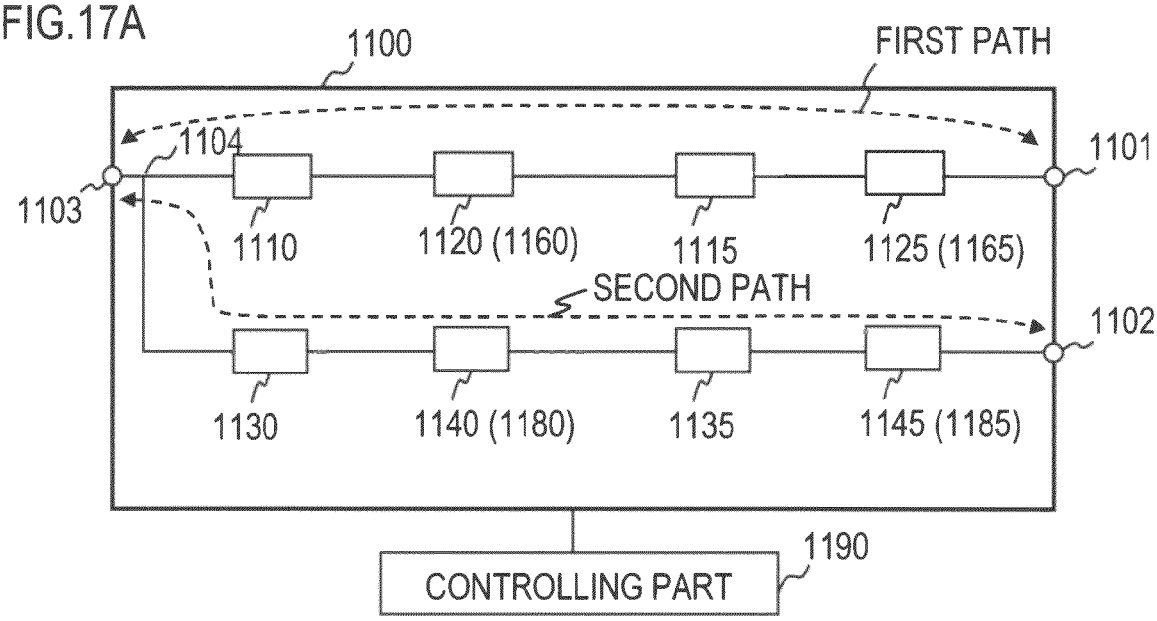
FIG. 17A is a diagram showing an exemplary configuration of a duplexer according to an embodiment 8.
Figure 17B:
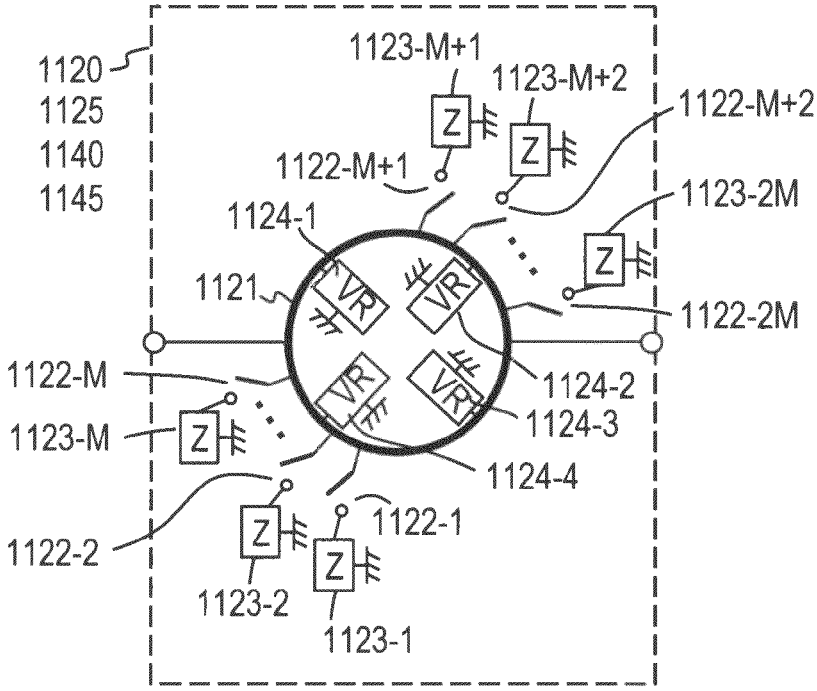
FIG. 17B is a diagram showing a specific configuration of a resonating part in the duplexer according to the embodiment 8.

FIG. 17A is a diagram showing an exemplary functional configuration of a duplexer according to an embodiment 8. FIG. 17B is a diagram showing a specific configuration of resonating parts 1120, 1125, 1140 and 1145. A duplexer 1100 has a first port 1101, a second port 1102 and a third port 1103 for external input/output. A first path is formed between the first port 1101 and the third port 1103, and a second path is formed between the second port 1102 and the third port 1103. The first path includes a phase shifting part 1110 having variable characteristics, a resonating part 1120, a phase shifting part 1115 having variable characteristics and a resonating part 1125, and the second path includes a phase shifting part 1130 having variable characteristics, a resonating part 1140, a phase shifting part 1135 having variable characteristics and a resonating part 1145. The duplexer 1100 further has a controlling part 1190 that controls the resonating parts 1120, 1125, 1140 and 1145 (more specifically, switches 1122-1 to 1122-2M) and the phase shifting parts 1110, 1115, 1130 and 1135 having variable characteristics. The phase shifting parts 1110, 1115, 1130 and 1135 are component parts that change the characteristics by changing the electrical length thereof.

The resonating parts 1120, 1125, 1140 and 1145 have a ring conductor 1121 having an input and an output apart from each other by 180° and four variable reactance means 1124-1 to 1124-4 connected at regular intervals to the ring conductor 1121. The resonating parts 1120, 1125, 1140 and 1145 further have a plurality of passive circuits 1123-1 to 1123-2M and a plurality of switches 1122-1 to 1122-2M, each of which is connected to a different part of the ring conductor 1121 at one end and to any of the passive circuits 1123-1 to 1123-2M at the other end. Alternatively, the passive circuits may be omitted, and the terminal of each switch connected to the passive circuit may be simply connected to a ground terminal. Alternatively, the passive circuits 1123-1 to 1123-2M may be passive circuits having a variable impedance. In this case, the controlling part 1190 also controls the passive circuits 1123-1 to 1123-2M. Furthermore, the resonating parts 1120, 1125, 1140 and 1145 may have different numbers of switches. The variable reactance means may be a varactor, for example.

Figure 18:
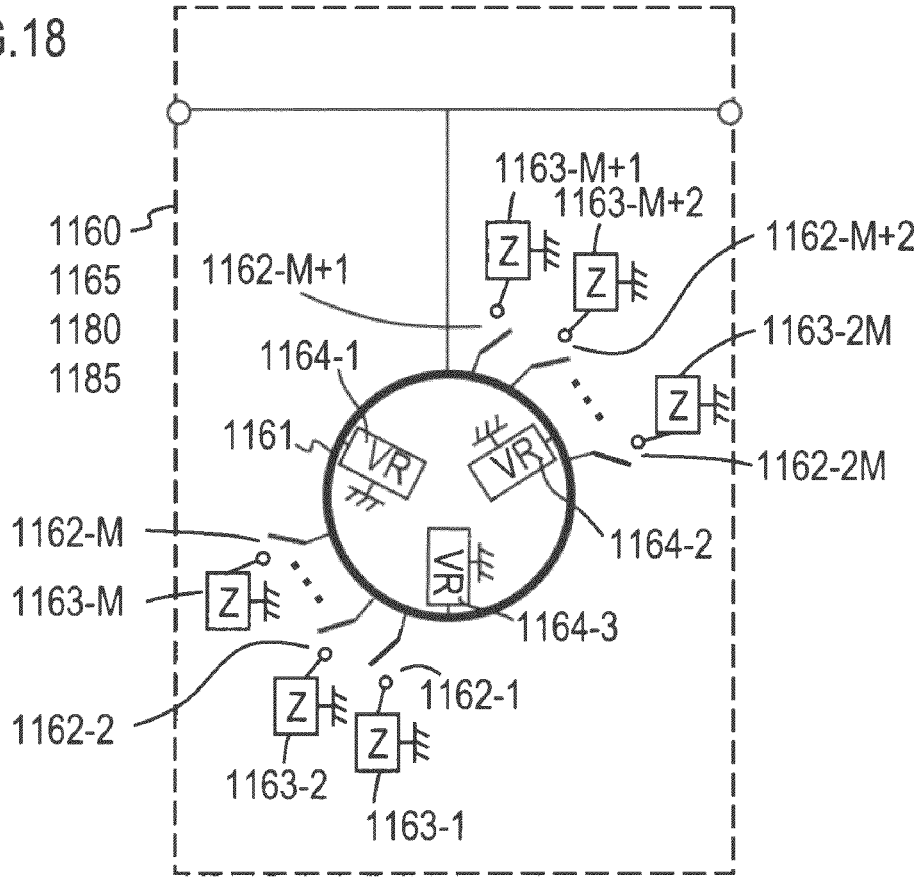
FIG. 18 is a diagram showing another exemplary configuration of the resonating part according to the embodiment 8.

Alternatively, the resonating parts 1120, 1125, 1140 and 1145 may be replaced with resonating parts 1160, 1165, 1180 and 1185 shown in FIG. 18. The resonating parts 1160, 1165, 1180 and 1185 have a ring conductor 1161 having a common input/output and three variable reactance means 1164-1 to 1164-3 connected at regular intervals to the ring conductor 1161. The resonating parts 1160, 1165, 1180 and 1185 further has a plurality of passive circuits 1163-1 to 1163-2M and a plurality of switches 1162-1 to 1162-2M, each of which is connected to a different part of the ring conductor 1161 at one end and to any of the passive circuits 1163-2 to 1163-2M at the other end.

The resonating parts 1120, 1125, 1140 and 1145 can change the resonant frequency by changing the reactance of the variable reactance means 1124-1 to 1124-4. The variable reactance means 1124-1 to 1124-4 change the respective reactances while making the reactances agree with each other. When the switch in the on state is changed, the position of the transmission zero and the susceptance slope parameter change. However, in this process, the resonant frequency does not change. That is, the resonant frequency is determined by the value of the reactance of the variable reactance means 1124-1 to 1124-4. On the other hand, the position of the transmission zero (the cutoff frequency) and the susceptance slope parameter are determined by which switch 1122-1 to 1122-2M is in the on state.

Figure 19:
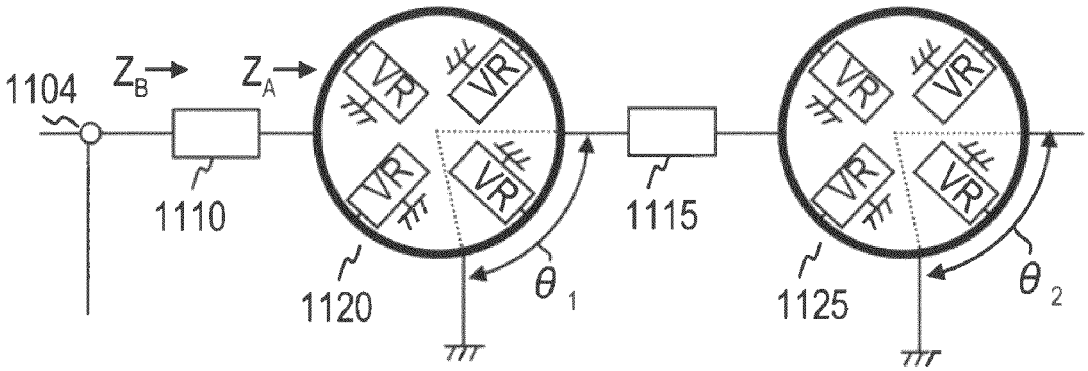
FIG. 19 is a diagram showing a simulation model for illustrating characteristics of a phase shifting part having variable characteristics.

The characteristics of the phase shifting part 1110 having variable characteristics are adjusted so that the characteristic impedance viewed from a point 1104 in the direction of the first port at a frequency f2 to be cut off in the first path increases (ideally to infinity). The characteristics of the phase shifting part 1130 having variable characteristics are adjusted so that the characteristic impedance viewed from the point 1104 in the direction of the second port at a frequency f1 to be cut off in the second path increases (ideally to infinity). FIG. 19 is a diagram for illustrating the characteristics of the phase shifting part 1110 having variable characteristics. As described above, the resonant frequencies f1 and f2 are determined by the value of the reactance of the variable reactance means 1124-1 to 1124-4. The position of the transmission zero and the susceptance slope parameter are determined by which switch 1122-1 to 1122-2M is in the on state. At the same time, the characteristic impedance $Z_A$ at the resonant frequency f2 viewed from the terminal of the phase shifting part 1110 having variable characteristics closer to the resonating part 1120 in the direction of the first port is also determined. The phase shifting part 1110 having variable characteristics can be adjusted so that the characteristic impedance $Z_B$ at the resonant frequency f2 (the frequency f2 to be cut off in the first path) viewed from the point 1104 in the direction of the first port increases.

Next, there will be described a fact that some of the switches 1122-1 to 1122-2M are equivalent to each other in terms of determination of the position of the transmission zero and the susceptance slope parameter. The ring conductor 1121 shown in FIG. 17B has a symmetrical configuration with respect to the line that connects the input and the output and with respect to the line that is perpendicular to the line connecting the input and the output and passes through the center of the ring conductor 1121. Therefore, switches at positions symmetrical with respect to any of the two lines and switches at positions symmetrical with respect to the center of the ring conductor 1121 are substantially equivalent to each other in terms of determination of the position of the transmission zero and the susceptance slope parameter. For example, the switch at the position $\theta_1$, the switch at the position $\theta_1+\pi/2$, the switch at the position $\theta_1+\pi$ and the switch at the position $\theta_1-\pi/2$ in FIG. 19 are substantially equivalent to each other (such switches will be referred to as "switches in a symmetrical relationship"). That is, regardless of which of the switches in a symmetrical relationship is turned on, the position of the transmission zero and the susceptance slope parameter are substantially the same as far as the passive circuit is the same. However, the characteristic impedance $Z_A$ at the frequency f2 viewed from the terminal of the phase shifting part 1110 having variable characteristics closer to the resonating part 1120 in the direction of the first port often varies depending on which of the switches in a symmetrical relationship is turned on.

That is, the phase shifting part 1110 can be more easily adjusted to increase the characteristic impedance $Z_A$ by appropriately selecting a switch from among the switches in a symmetrical relationship. For example, in a case where a plurality of combinations of a resonant frequency, positions of the transmission zero (cutoff frequencies) and a susceptance slope parameter are required, candidates for positions of the switches to be connected (candidates for positions of switches in a symmetrical relationship) are determined for each combination. From among these candidates, the positions of the switches to be connected can be determined so that the variation of the characteristic (electrical length) that the phase shifting part 1110 has to adjust to achieve all the combinations is reduced. Such positions may be previously determined by measurement or calculation or selected each time the combinations are changed. However, the present invention is not limited to these methods. Furthermore, the controlling part 1190 may store information about the previously determined positions or a process for selecting the positions of the switches each time the combinations are changed. That is, the controlling part 1190 selects from among the switches 1122-1 to 1122-2M in such a manner that the variation of the characteristic of the phase shifting part 1110 is reduced.

Next, a result of simulation using the model shown in FIG. 19 will be specifically described. In this simulation, the position (angle) of the switch connected to the ring conductor is denoted by $\theta_1$ or $\theta_2$. $\theta_1$ denotes the position (angle) of the switch connected to the ring conductor of the resonating part 1120, and $\theta_2$ denotes the position (angle) of the switch connected to the ring conductor of the resonating part 1125. In this model, the terminal of the switch on the side of the passive circuit is simply connected to a ground electrode. There are four combinations of a resonant frequency and positions of the transmission zero (cutoff frequencies), that is, (resonant frequency, cutoff frequencies)=(5 GHz, 6.43 GHz and 6 GHz), (5 GHz, 5.62 GHz and 5.29 GHz), (3.43 GHz, 4.33 GHz and 4.13 GHz) and (3.43 GHz, 3.89 GHz and 3.65 GHz). In this simulation, the resonant frequency is 5 GHz when the four variable reactance means each have a reactance of 0 pF (this is the same as the state where no variable reactance means is connected). The resonant frequency is 3.43 GHz when the four variable reactance means each have a reactance of 1 pF.

Figure 20:
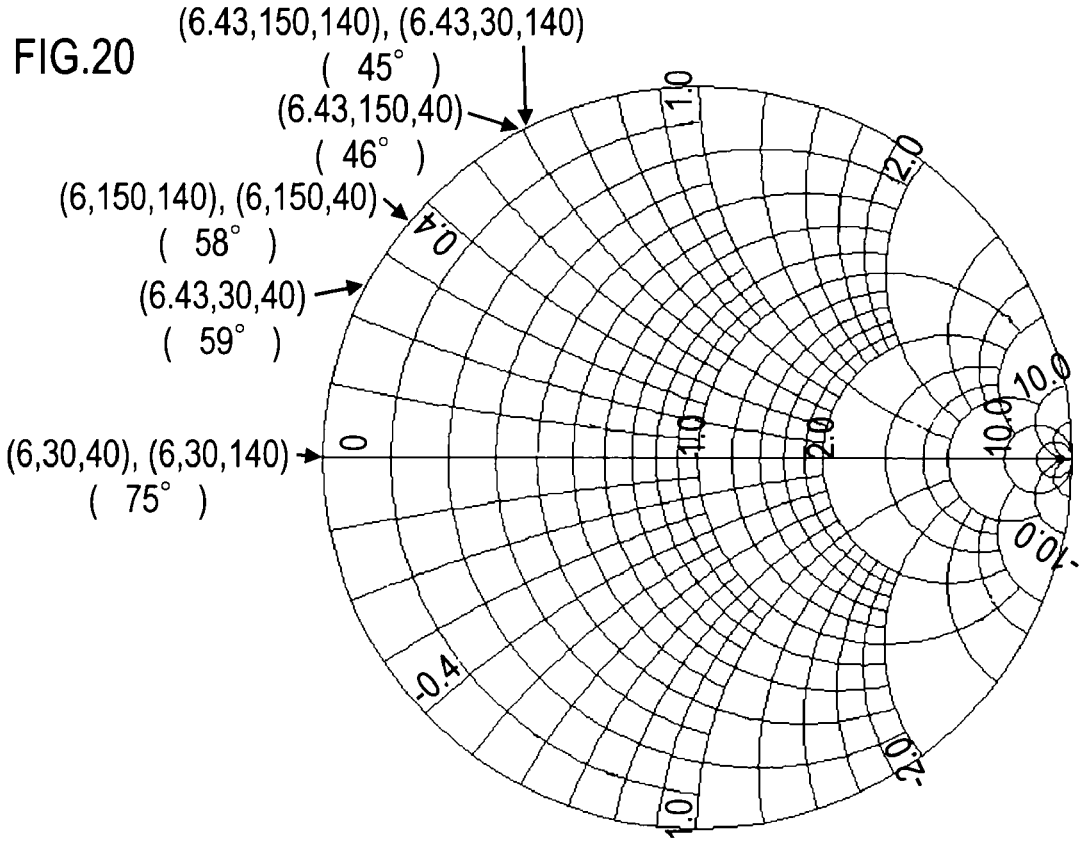
FIG. 20 shows a Smith chart showing the characteristic impedance $Z_A$ in cases where the resonant frequency is 5 GHz, the cutoff frequencies are 6.43 GHz and 6 GHz, and the positions of switches ($\theta_1$, $\theta_2$) are (30°, 40°), (150°, 140°), (150°, 40°) and (30°, 140°)
Figure 21:
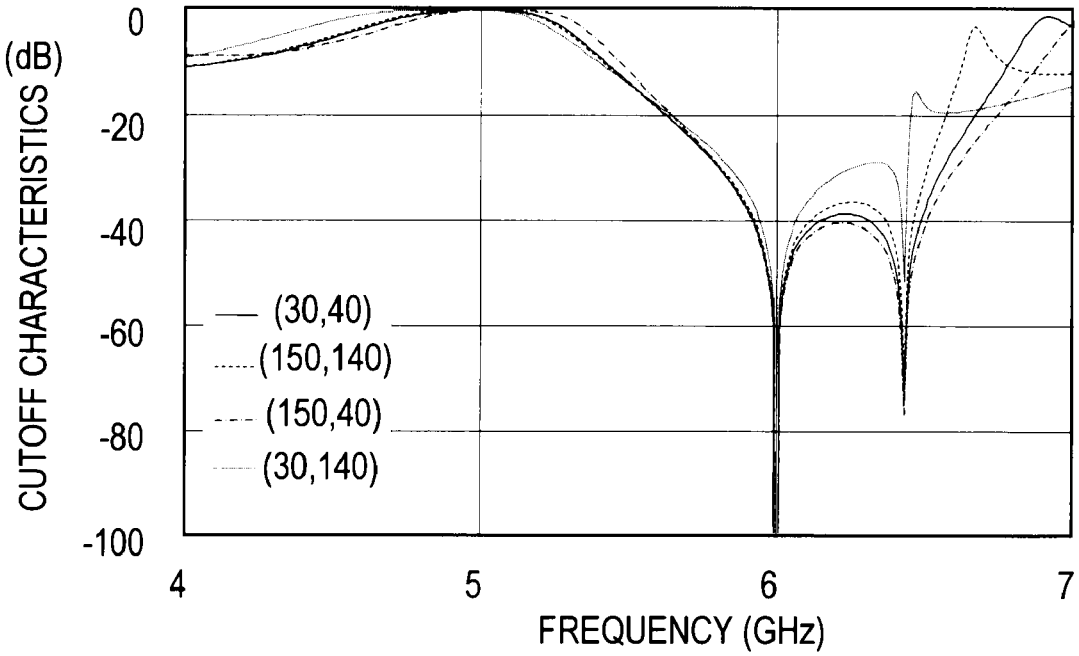
FIG. 21 is a graph showing frequency characteristics for the cases where the resonant frequency is 5 GHz, the cutoff frequencies are 6.43 GHz and 6 GHz, and the positions of switches ($\theta_1$, $\theta_2$) are (30°, 40°), (150°, 140°), (150°, 40°) and (30°, 140°)
Figure 22:
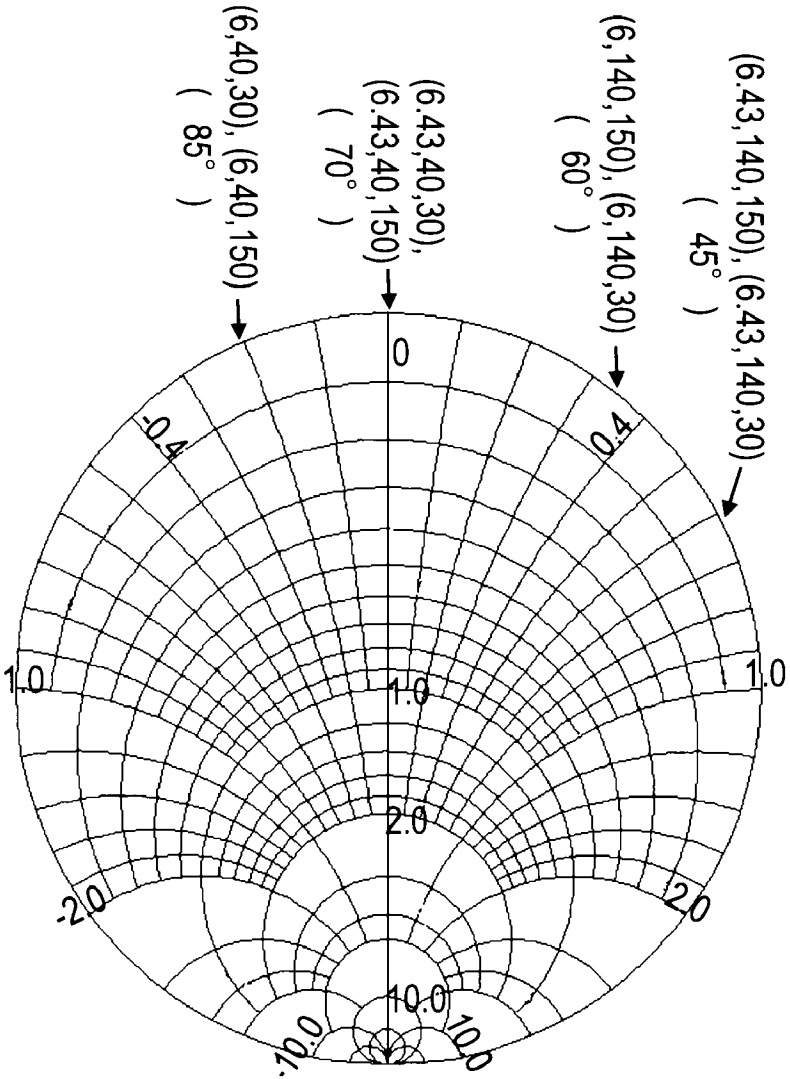
FIG. 22 shows a Smith chart showing the characteristic impedance $Z_A$ in cases where the resonant frequency is 5 GHz, the cutoff frequencies are 6.43 GHz and 6 GHz, and the positions of switches ($\theta_1$, $\theta_2$) are (40°, 30°), (140°, 150°), (140°, 30°) and (40°, 150°)
Figure 23:
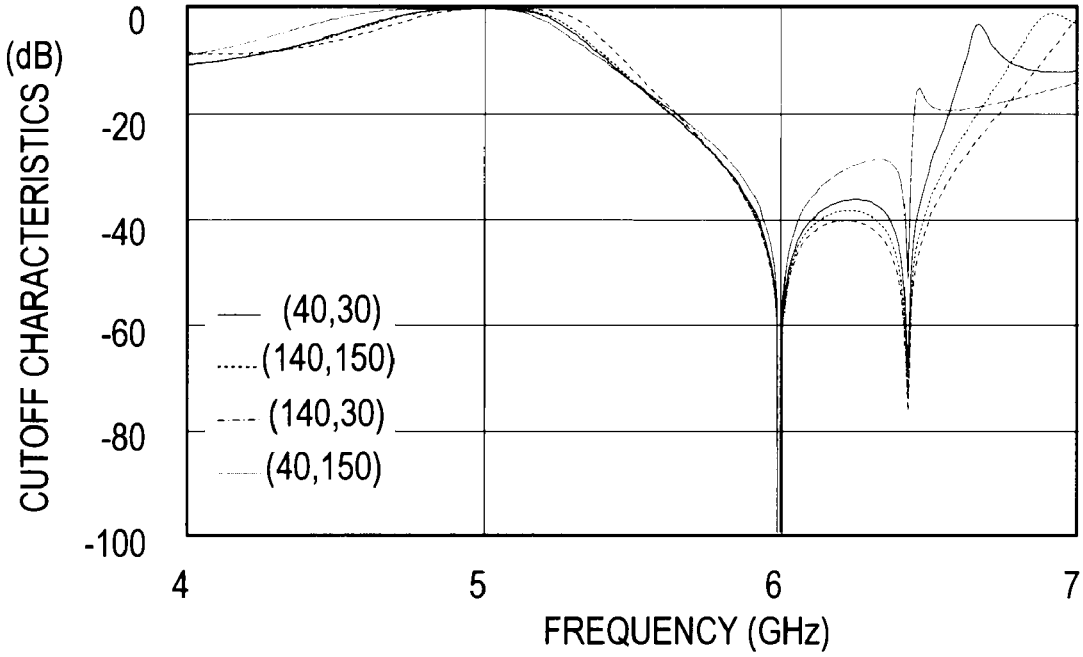
FIG. 23 is a graph showing frequency characteristics for the cases where the resonant frequency is 5 GHz, the cutoff frequencies are 6.43 GHz and 6 GHz, and the positions of switches ($\theta_1$, $\theta_2$) are (40°, 30°), (140°, 150°), (140°, 30°) and (40°, 150°)

FIG. 20 shows a Smith chart showing the characteristic impedance $Z_A$ in cases where the resonant frequency is 5 GHz, the cutoff frequencies are 6.43 GHz and 6 GHz, and the positions of switches ($\theta_1$, $\theta_2$) are (30°, 40°), (150°, 140°), (150°, 40°) and (30°, 140°). FIG. 21 is a graph showing frequency characteristics for the respective cases. FIG. 20 also shows the electrical length $\phi$ required to increase the characteristic impedance $Z_A$ to infinity for each combination of a cutoff frequency and positions $\theta_1$ and $\theta_2$ (cutoff frequency (GHz), $\theta_1$(°), $\theta_2$(°)). In this drawing, the electrical length $\phi$ is shown in terms of the wavelength at 5 GHz expressed in units of degree (360° means one wavelength at 5 GHz). It is to be noted that, in the following description, the electrical length $\phi$ is shown in terms of the wavelength at 5 GHz expressed in units of degree regardless of the resonant frequency and the cutoff frequency. FIG. 22 shows a Smith chart showing the characteristic impedance $Z_A$ in cases where the resonant frequency is 5 GHz, the cutoff frequencies are 6.43 GHz and 6 GHz, and the positions of switches ($\theta_1$, $\theta_2$) are (40°, 30°), (140°, 150°), (140°, 30°) and (40°, 150°). FIG. 23 is a graph showing frequency characteristics for the respective cases.

As can be seen from FIGS. 21 and 23, the resonant frequency, the positions of the transmission zero (cutoff frequencies) and the susceptance slope parameter do not substantially change even when the combination of $\theta_1$ and $\theta_2$ is changed. In the above description of the switches in a symmetrical relationship, characteristics in a single resonating part have been described. However, from FIGS. 21 and 23, it can be seen that the resonant frequency, the positions of the transmission zero (cutoff frequencies) and the susceptance slope parameter do not substantially change even when the positions $\theta_1$ and $\theta_2$ are interchanged. Therefore, the positions (angles) of the switches that provide substantially the same resonant frequency, positions of the transmission zero (cutoff frequencies) and susceptance slope parameter are not limited to those in a symmetrical relationship. From FIGS. 20 and 22, it can be seen that the electrical length $\phi$ required to increase the characteristic impedance $Z_A$ to infinity varies even for the combinations of $\theta_1$ and $\theta_2$ that provide substantially the same resonant frequency, positions of the transmission zero and susceptance slope parameter.

Figure 24:
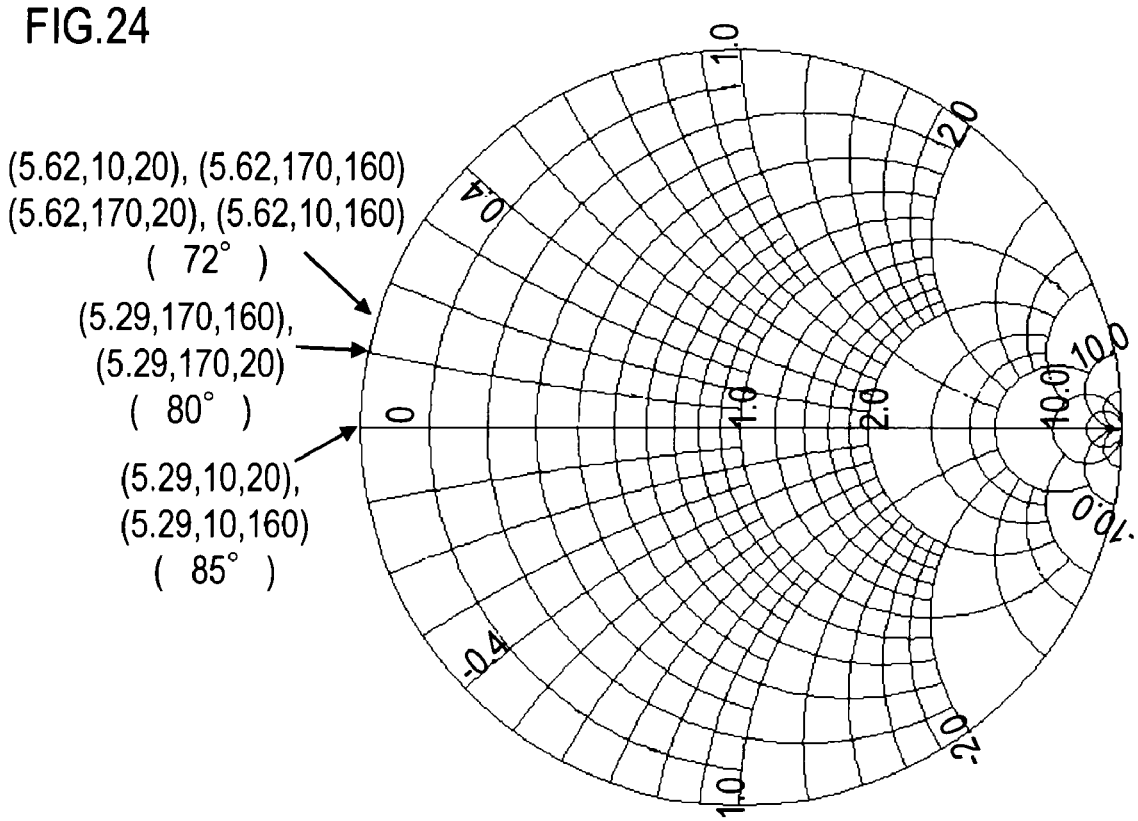
FIG. 24 shows a Smith chart showing the characteristic impedance $Z_A$ in cases where the resonant frequency is 5 GHz, the cutoff frequencies are 5.29 GHz and 5.62 GHz, and the positions of switches ($\theta_1$, $\theta_2$) are (10°, 20°), (170°, 160°), (170°, 20°) and (10°, 160°)
Figure 25:
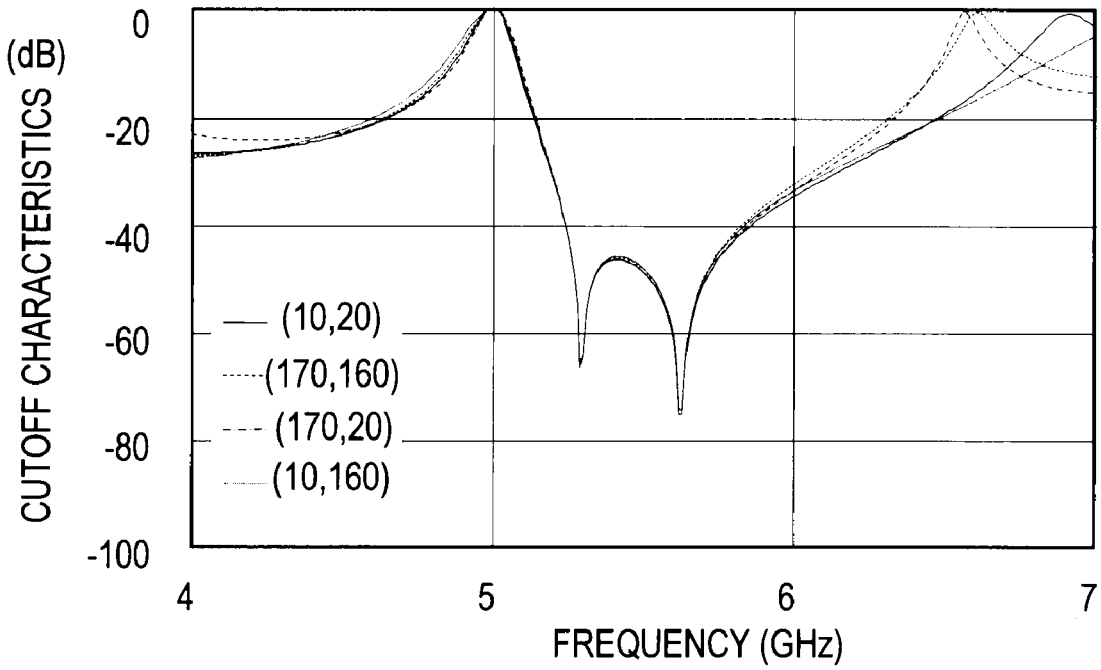
FIG. 25 is a graph showing frequency characteristics for the cases where the resonant frequency is 5 GHz, the cutoff frequencies are 5.29 GHz and 5.62 GHz, and the positions of switches ($\theta_1$, $\theta_2$) are (10°, 20°), (170°, 160°), (170°, 20°) and (10°, 160°)
Figure 26:
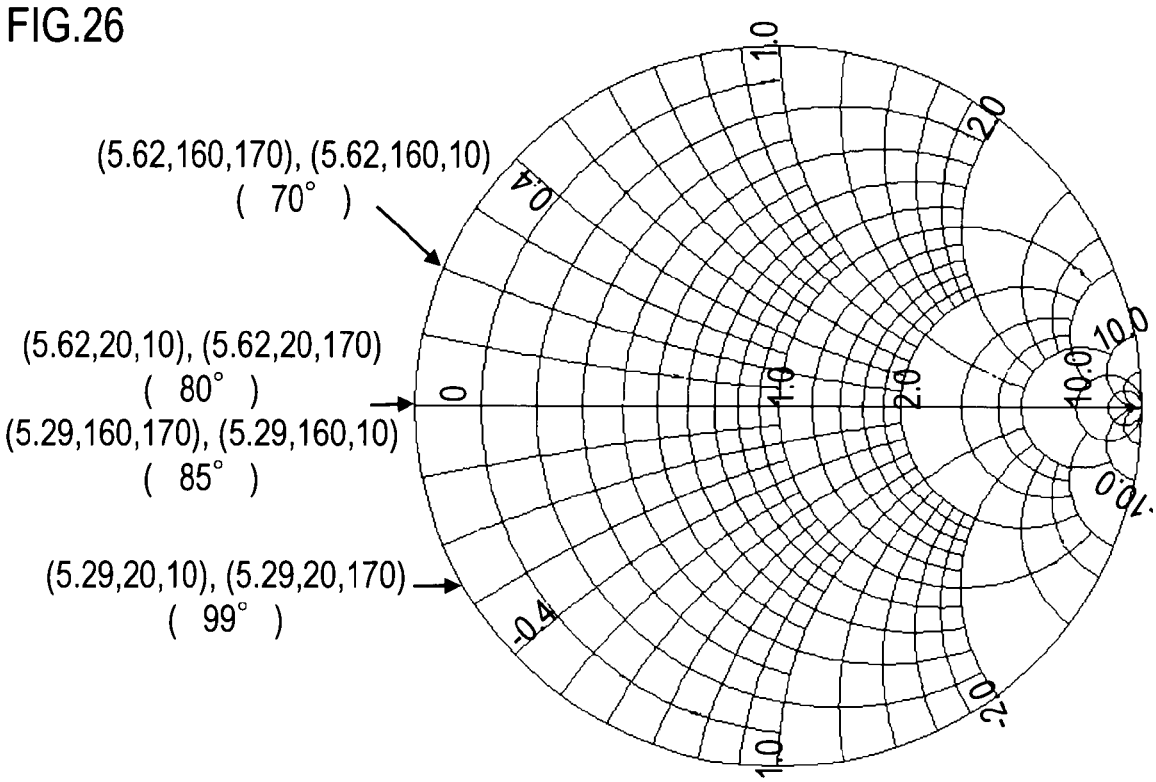
FIG. 26 shows a Smith chart showing the characteristic impedance $Z_A$ in cases where the resonant frequency is 5 GHz, the cutoff frequencies are 5.29 GHz and 5.62 GHz, and the positions of switches ($\theta_1$, $\theta_2$) are (20°, 10°), (160°, 170°), (160°, 10°) and (20°, 170°)
Figure 27:
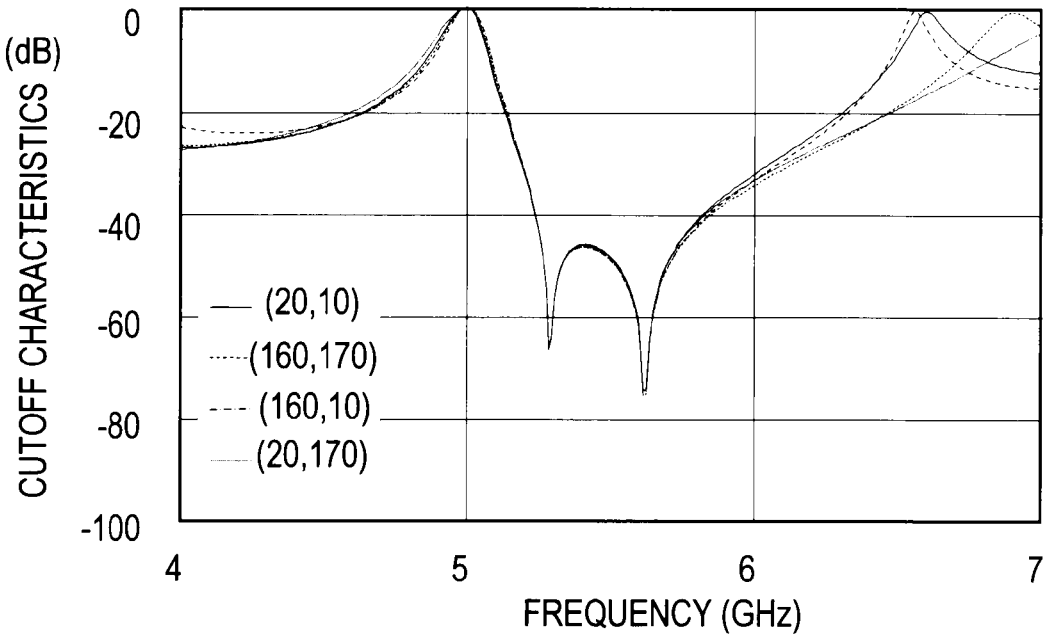
FIG. 27 is a graph showing frequency characteristics for the cases where the resonant frequency is 5 GHz, the cutoff frequencies are 5.29 GHz and 5.62 GHz, and the positions of switches ($\theta_1$, $\theta_2$) are (20°, 10°), (160°, 170°), (160°, 10°) and (20°, 170°)

FIG. 24 shows a Smith chart showing the characteristic impedance $Z_A$ in cases where the resonant frequency is 5 GHz, the cutoff frequencies are 5.29 GHz and 5.62 GHz, and the positions of switches ($\theta_1$, $\theta_2$) are (10°, 20°), (170°, 160°), (170°, 20°) and (10°, 160°). FIG. 25 is a graph showing frequency characteristics for the respective cases. FIG. 26 shows a Smith chart showing the characteristic impedance $Z_A$ in cases where the resonant frequency is 5 GHz, the cutoff frequencies are 5.29 GHz and 5.62 GHz, and the positions of switches ($\theta_1$, $\theta_2$) are (20°, 10°), (160°, 170°), (160°, 10°) and (20°, 170°). FIG. 27 is a graph showing frequency characteristics for the respective cases. From FIGS. 25 and 27, it can be seen that the resonant frequency, the positions of the transmission zero (cutoff frequencies) and the susceptance slope parameter do not substantially change even when the positions $\theta_1$ and $\theta_2$ are interchanged. Furthermore, from comparison between FIGS. 21 and 23 and FIGS. 25 and 27, it can be seen that the positions of the transmission zero (cutoff frequencies) and the susceptance slope parameter can be changed while keeping the resonant frequency constant by changing the combination of $\theta_1$ and $\theta_2$. Furthermore, from FIGS. 24 and 26, it can be seen that the electrical length $\phi$ required to increase the characteristic impedance $Z_A$ to infinity varies even for the combinations of $\theta_1$ and $\theta_2$ that provide substantially the same resonant frequency, positions of the transmission zero and susceptance slope parameter.

Figure 28:
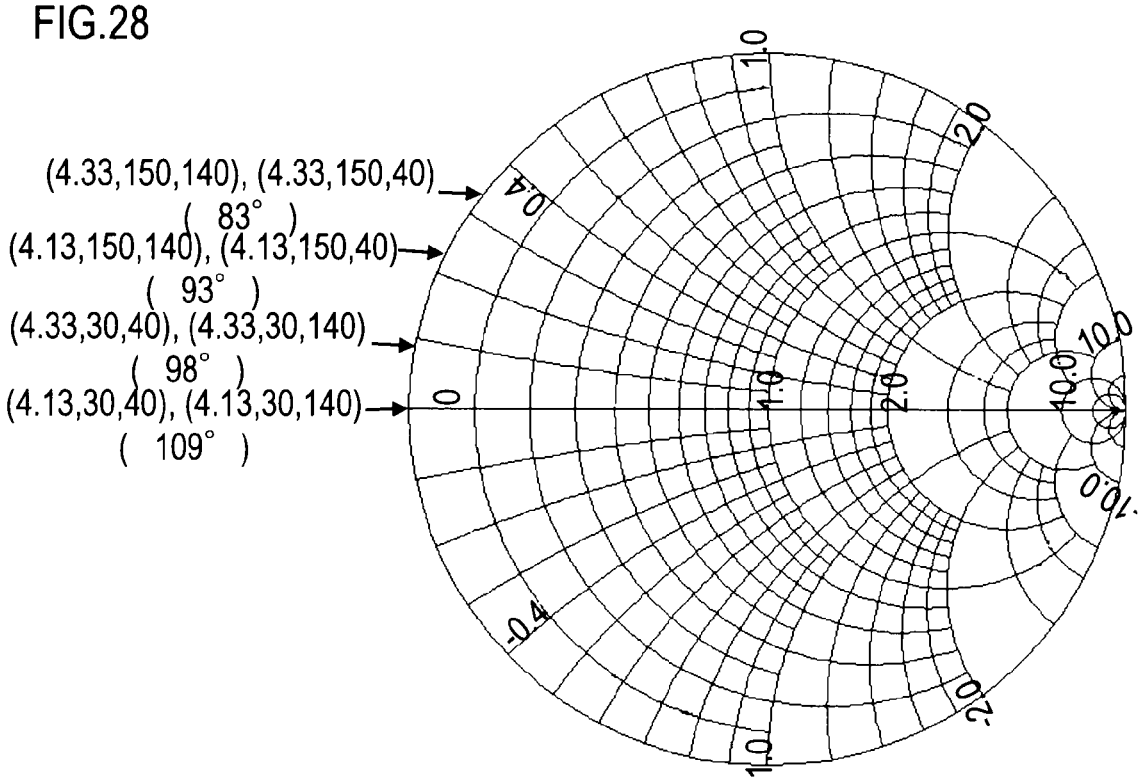
FIG. 28 shows a Smith chart showing the characteristic impedance $Z_A$ in cases where the resonant frequency is 3.43 GHz, the cutoff frequencies are 4.33 GHz and 4.13 GHz, and the positions of switches ($\theta_1$, $\theta_2$) are (30°, 40°), (150°, 140°), (150°, 40°) and (30°, 140°)
Figure 29:
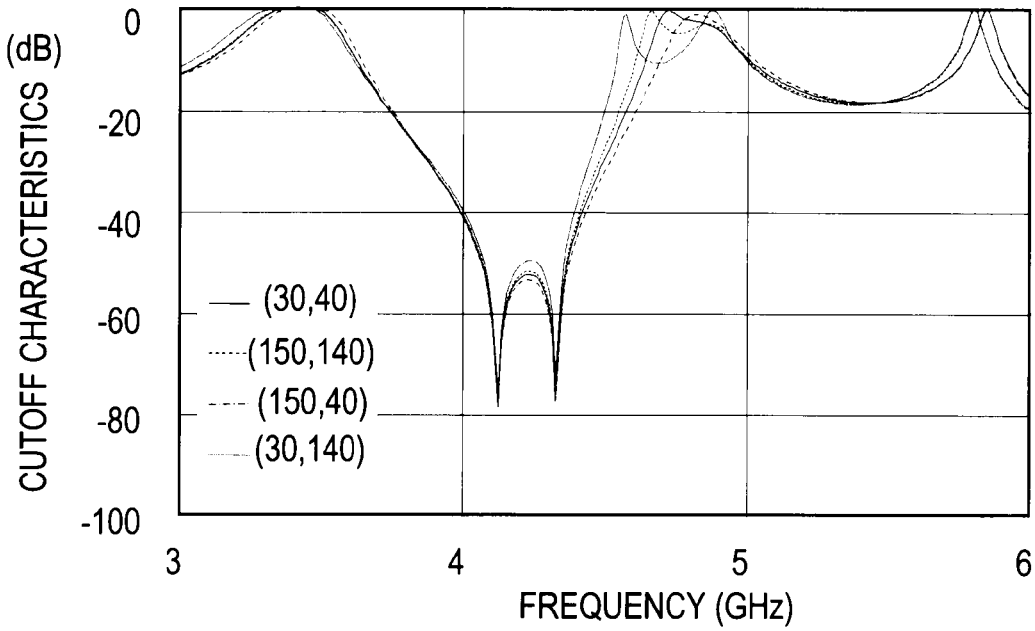
FIG. 29 is a graph showing frequency characteristics for the cases where the resonant frequency is 3.43 GHz, the cutoff frequencies are 4.33 GHz and 4.13 GHz, and the positions of switches ($\theta_1$, $\theta_2$) are (30°, 40°), (150°, 140°), (150°, 40°) and (30°, 140°)
Figure 30:
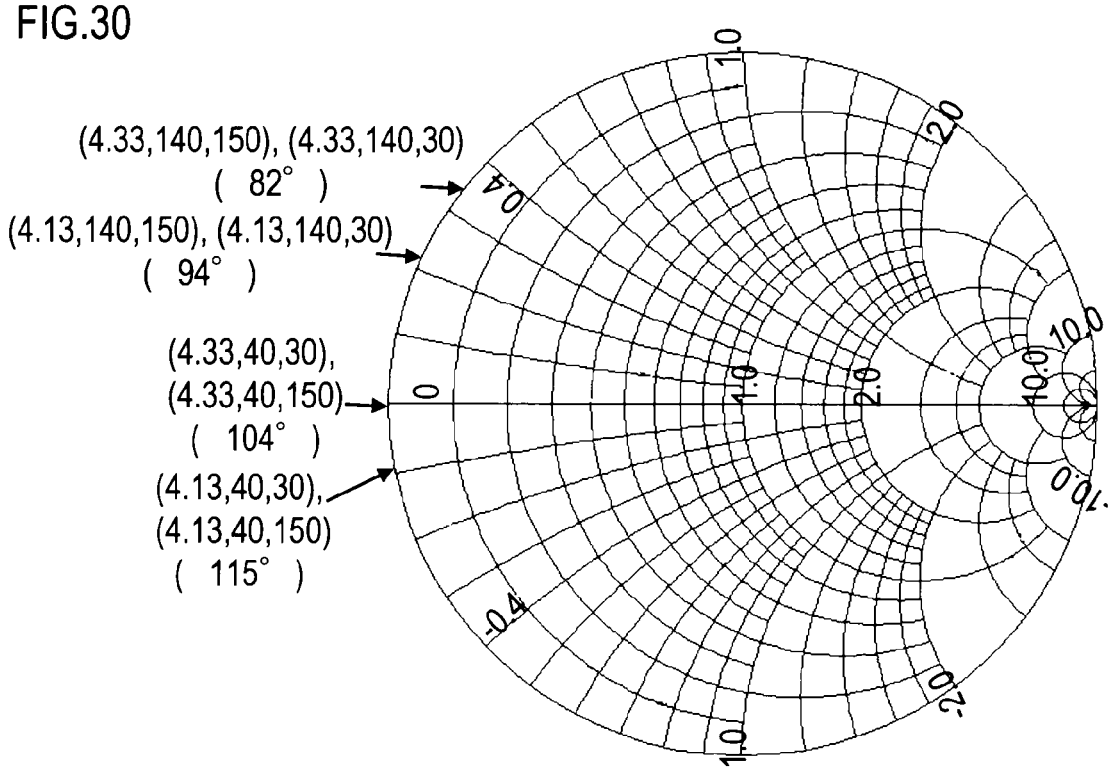
FIG. 30 shows a Smith chart showing the characteristic impedance $Z_A$ in cases where the resonant frequency is 3.43 GHz, the cutoff frequencies are 4.33 GHz and 4.13 GHz, and the positions of switches ($\theta_1$, $\theta_2$) are (40°, 30°), (140°, 150°), (140°, 30°) and (40°, 150°)
Figure 31:
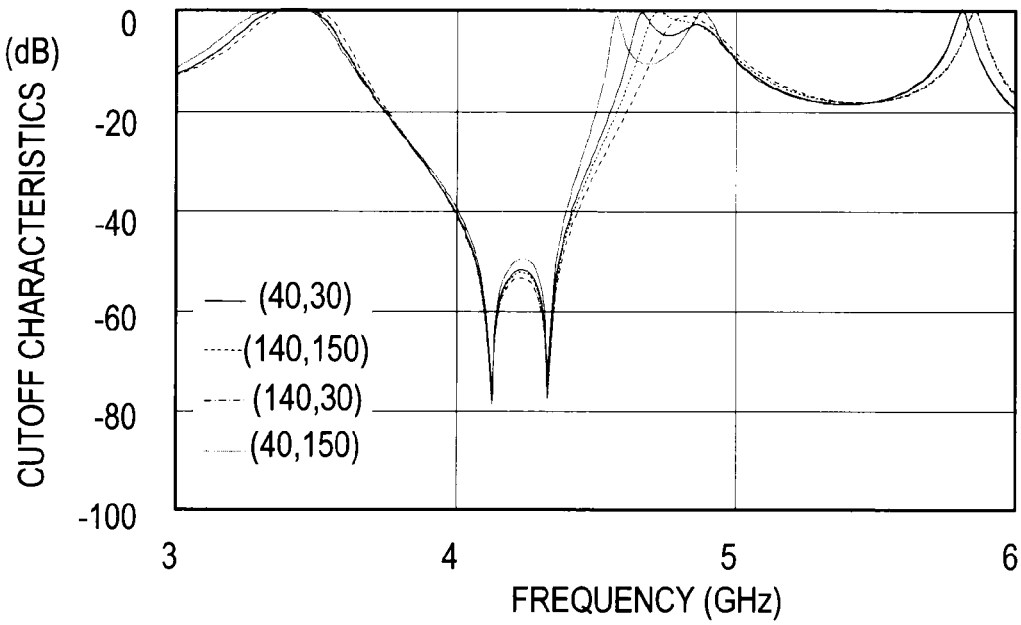
FIG. 31 is a graph showing frequency characteristics for the cases where the resonant frequency is 3.43 GHz, the cutoff frequencies are 4.33 GHz and 4.13 GHz, and the positions of switches ($\theta_1$, $\theta_2$) are (40°, 30°), (140°, 150°), (140°, 30°) and (40°, 150°)
Figure 32:
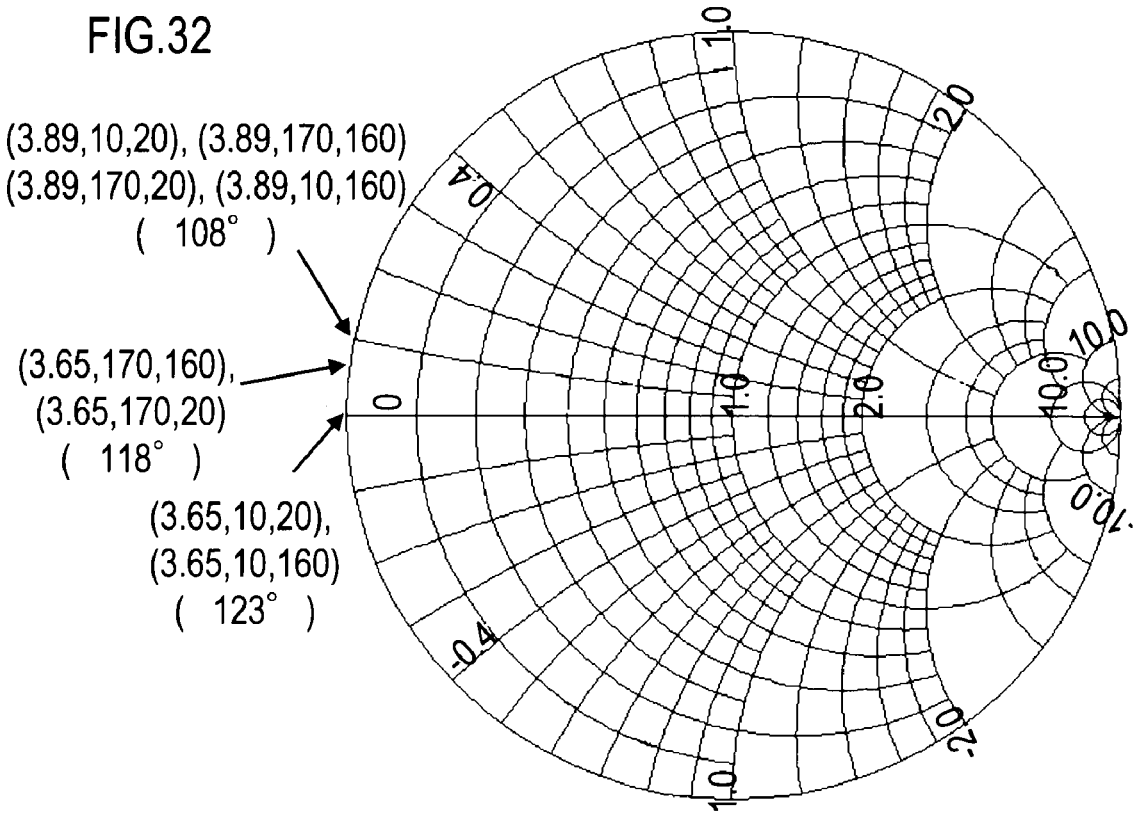
FIG. 32 shows a Smith chart showing the characteristic impedance $Z_A$ in cases where the resonant frequency is 3.43 GHz, the cutoff frequencies are 3.89 GHz and 3.65 GHz, and the positions of switches ($\theta_1$, $\theta_2$) are (10°, 20°), (170°, 160°), (170°, 20°) and (10°, 160°)
Figure 33:
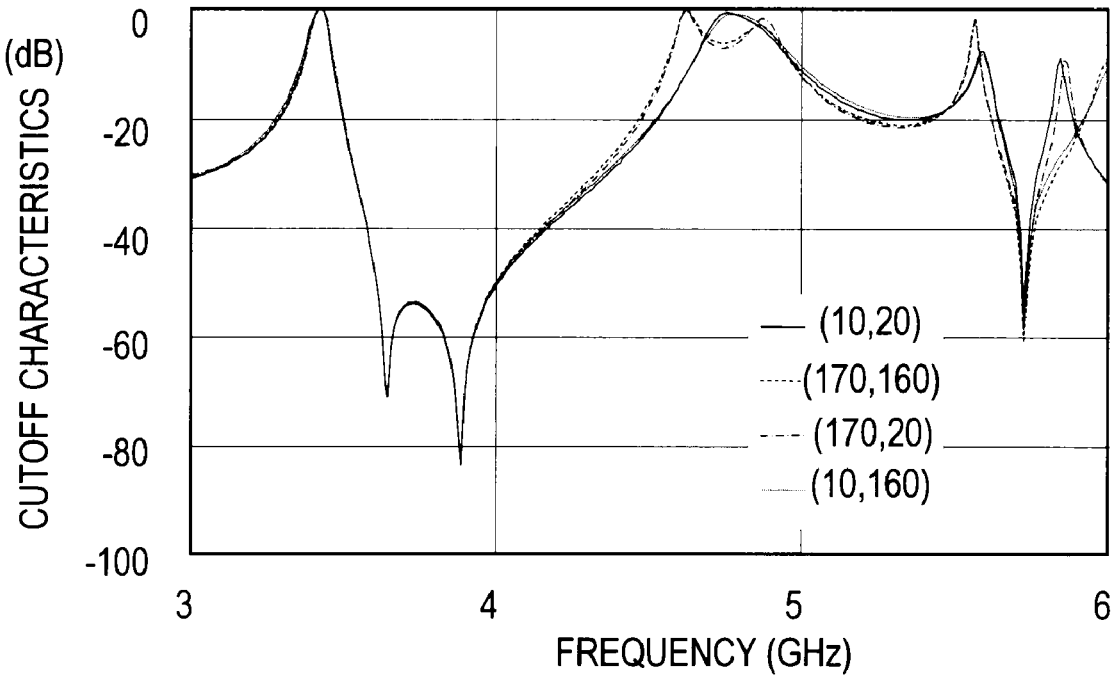
FIG. 33 is a graph showing frequency characteristics for the cases where the resonant frequency is 3.43 GHz, the cutoff frequencies are 3.89 GHz and 3.65 GHz, and the positions of switches ($\theta_1$, $\theta_2$) are (10°, 20°), (170°, 160°), (170°, 20°) and (10°, 160°)
Figure 34:
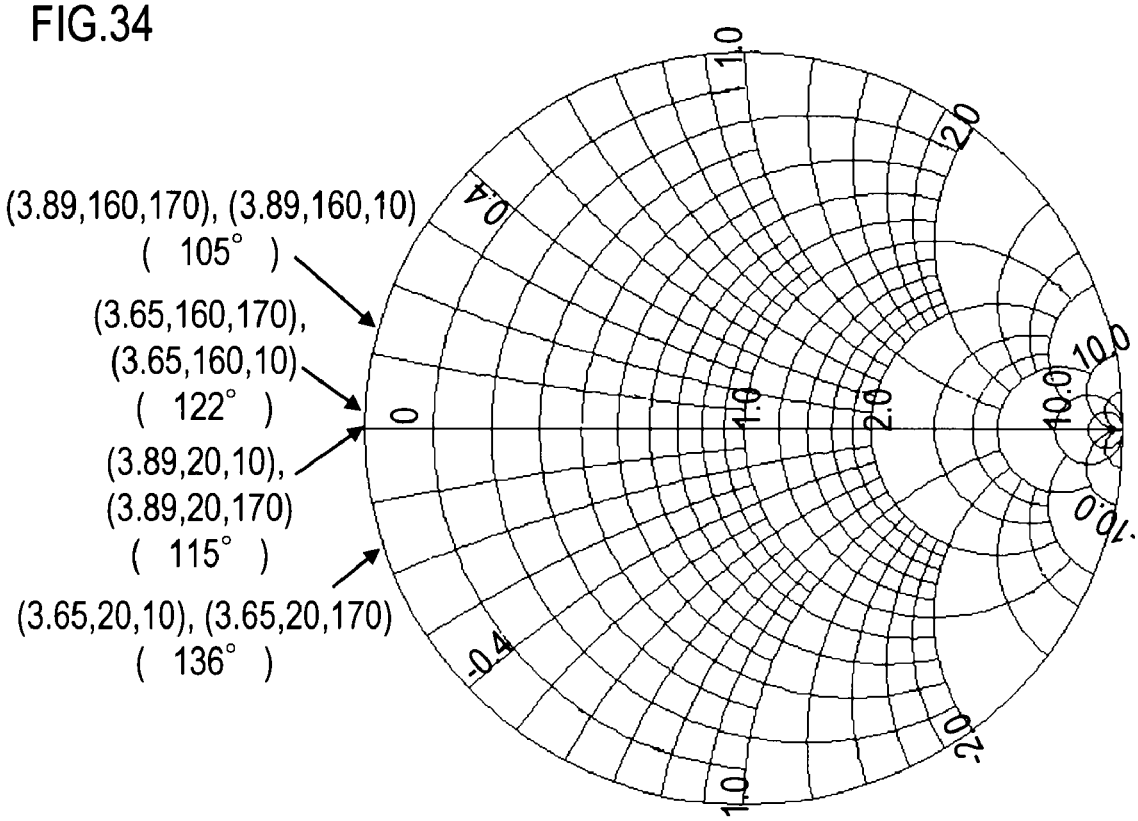
FIG. 34 shows a Smith chart showing the characteristic impedance $Z_A$ in cases where the resonant frequency is 3.43

FIG. 28 shows a Smith chart showing the characteristic impedance $Z_A$ in cases where the resonant frequency is 3.43 GHz, the cutoff frequencies are 4.33 GHz and 4.13 GHz, and the positions of switches ($\theta_1$, $\theta_2$) are (30°, 40°), (150°, 140°), (150°, 40°) and (30°, 140°). FIG. 29 is a graph showing frequency characteristics for the respective cases. FIG. 30 shows a Smith chart showing the characteristic impedance $Z_A$ in cases where the resonant frequency is 3.43 GHz, the cutoff frequencies are 4.33 GHz and 4.13 GHz, and the positions of switches ($\theta_1$, $\theta_2$) are (40°, 30°), (140°, 150°), (140°, 30°) and (40°, 150°). FIG. 31 is a graph showing frequency characteristics for the respective cases. FIG. 32 shows a Smith chart showing the characteristic impedance $Z_A$ in cases where the resonant frequency is 3.43 GHz, the cutoff frequencies are 3.89 GHz and 3.65 GHz, and the positions of switches ($\theta_1$, $\theta_2$) are (10°, 20°), (170°, 160°), (170°, 20°) and (10°, 160°). FIG. 33 is a graph showing frequency characteristics for the respective cases. FIG. 34 shows a Smith chart showing the characteristic impedance $Z_A$ in cases where the resonant frequency is 3.43 GHz, the cutoff frequencies are 3.89 GHz and 3.65 GHz, and the positions of switches ($\theta_1$, $\theta_2$) are (20°, 10°), (160°, 170°), (160°, 10°) and (20°, 170°). FIG. 35 is a graph showing frequency characteristics for the respective cases. FIGS. 29 to 35 also show the same results as those confirmed with reference to FIGS. 20 to 28.

That is, from FIGS. 20 to 35, it can be seen that (1) the resonant frequency is determined by the variable reactance means, (2) the positions of the transmission zero (cutoff frequencies) and the susceptance slope parameter can be changed while keeping the resonant frequency constant by changing the combination of $\theta_1$ and $\theta_2$, and (3) the electrical length $\phi$ required to increase the characteristic impedance $Z_A$ to infinity varies even for the combinations of $\theta_1$ and $\theta_2$ that provide substantially the same resonant frequency, positions of the transmission zero (cutoff frequencies) and susceptance slope parameter.

FIG. 36 is a table showing results of the simulation in the case where the resonant frequency is 5 GHz. FIG. 37 is a table showing results of the simulation in the case where the resonant frequency is 3.43 GHz. For example, a resonant frequency of 5 GHz and a cutoff frequency of 6.43 GHz can be achieved by setting the reactance C, of the variable reactance means at 0 pF and selecting the combination ($\theta_1$, $\theta_2$) from among (30°, 140°), (150°, 140°), (140°, 30°), (140°, 150°), (150°, 40°), (30°, 40°), (40°, 30°) and (40°, 150°). The electrical length $\phi$ of the phase shifting part depends on the combination of $\theta_1$ and $\theta_2$.

In FIGS. 36 and 37, the shortest electrical length $\phi$ is 45°, and the longest electrical length $\phi$ is 136°. Therefore, if the combination of $\theta_1$ and $\theta_2$ is determined without taking the electrical length $\phi$ into account, the phase shifting part has to vary the electrical length $\phi$ from 45° to 136° in the worst case. That is, a variation of 91° is required. On the other hand, if ($\theta_1$, $\theta_2$)=(40°, 30°) or (40°, 150°) when the resonant frequency is 5 GHz and the cutoff frequency is 6.43 GHz, or if ($\theta_1$, $\theta_2$)=(170°, 20°) or (170°, 160°) when the resonant frequency is 3.43 GHz and the cutoff frequency is 3.65 GHz, the phase shifting part is required to vary the electrical length $\phi$ only by 48° (from 70° to 118°). That is, the variation required is about a half of that in the worst case. Therefore, the controlling part 1190 of the duplexer 1100 shown in FIG. 17A selects from among the switches 1122-1 to 1122-2M so that the variation of the phase shifting parts 1110, 1115, 1130 and 1135 having variable characteristics decreases and adjusts the characteristics of the phase shifting parts 1110, 1115, 1130 and 1135 according to the switch in the on state.

As described above, the duplexer 1100 according to the embodiment 8 can (1) determine the resonant frequency by means of the variable reactance means, (2) selects a plurality of candidates for switches that can provide desired positions of the transmission zero (cutoff frequencies) and a desired susceptance slope parameter while keeping the resonant frequency constant, and (3) determine the variation of the phase shifting parts after selecting a switch that reduces the variation of the phase shifting parts from the plurality of candidate switches.

In the embodiments 1 to 8 described above, any particular shape of the ring conductor has not been described. Thus, next, there will be described preferred configurations of the ring conductor and the input/output line in the vicinity of the point of connection between the ring conductor and the input/output line. FIG. 38A shows an exemplary configuration of the ring conductor and the input/output line in which the input/output line is slightly thicker in a part close to the point of connection between the ring conductor and the input/output line. FIG. 38B shows an exemplary configuration of the ring conductor and the input/output line in which there is a stub in the vicinity of the point of connection between the ring conductor and the input/output line. FIG. 38C shows an exemplary configuration of the ring conductor and the input/output line in which the ring conductor is widened in a part close to the point of connection between the ring conductor and the input/output line. In general, when a line and a ring having the same characteristic impedance are connected at right angles to each other, the characteristic impedance is higher in the vicinity of the point of connection than the other parts. The variation in characteristic impedance causes an impedance mismatch, and there arises a problem that the resonant frequency varies if the switch turned on is changed. To reduce the impedance mismatch, in the configurations shown in FIGS. 38A, 38B and 38C, the impedance in the vicinity of the point of connection is reduced. With such configurations, the impedance mismatch due to the connection between the ring conductor and the input/output line can be reduced, and thus, the resonant frequency can be kept constant even if the switch turned on is changed. And when input to and output from a ring conductor occur at different positions apart from each other by 180°, the duplexer with such configurations in a part close to the point of connection between the ring conductor and the input/output line has the same advantages.

In the embodiments 1 to 8 described above, examples in which there are two paths (one transmission path and one reception path) have been shown. However, for example, when a plurality of frequency bands is provided for reception, the number of ports can be increased, and the number of paths can be increased. Such a duplexer can be considered as including the duplexer according to any of the embodiments described above. Furthermore, a transceiver having such a duplexer is reduced in size and weight.

What is claimed is:

1. A duplexer, comprising:

a first port, a second port and a third port for external input/output;

a first path being formed between the first port and the third port;

a second path being formed between the second port and the third port;

a phase shifting part provided for each path, the phase shifting parts having variable characteristics;

a resonating part provided for each path, wherein at least any of said resonating parts has a ring conductor having a length equal to one wavelength at a resonant frequency or an integral multiple thereof, and a plurality of switches each of which is connected to a different part of said ring conductor at one end and to a passive circuit or ground conductor at the other end; and a controlling part that controls said switches and said phase shifting parts, wherein said controlling part selects from among said switches so that the variation of the characteristics of said phase shifting parts is reduced.

2. The duplexer according to claim 1, wherein an impedance of said passive circuits includes a reactance component.

3. The duplexer according to claim 1, wherein said passive circuits are capable of changing an impedance.

4. The duplexer according to any of claim 1, wherein said resonating parts have three or more variable reactance components connected to said ring conductor.

5. A transceiver that has the duplexer according to any of claims 1 2, 3, and 4.

* * * * *